US010918160B2

(12) United States Patent
Hopkins et al.

(10) Patent No.: US 10,918,160 B2
(45) **Date of Patent: *Feb. 16, 2021**

(54) HINGED FOOTWEAR SOLE STRUCTURE FOR FOOT ENTRY AND METHOD OF MANUFACTURING

(71) Applicant: NIKE, Inc., Beaverton, OR (US)

(72) Inventors: Timothy P. Hopkins, Lake Oswego, OR (US); Austin Orand, Portland, OR (US); Haley Toelle, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 34 days.

This patent is subject to a terminal disclaimer.

(21) Appl. No.: 16/400,078

(22) Filed: May 1, 2019

(65) Prior Publication Data

US 2019/0254381 A1 Aug. 22, 2019

Related U.S. Application Data

(62) Division of application No. 15/792,059, filed on Oct. 24, 2017, now Pat. No. 10,602,802.
(Continued)

(51) Int. Cl.
*A43B 11/00* (2006.01)
*A43B 3/24* (2006.01)
(Continued)

(52) U.S. Cl.
CPC ..... *A43B 11/00* (2013.01); *A43B 3/248* (2013.01); *A43B 13/141* (2013.01);
(Continued)

(58) Field of Classification Search
CPC .. A43B 3/06; A43B 3/248; A43B 3/26; A43B 11/00; A43C 1/006
(Continued)

(56) References Cited

U.S. PATENT DOCUMENTS 1,081,678 A * 12/1913 Langerak ..... A43B 11/00 36/138
1,812,622 A 6/1931 Costello
(Continued)

FOREIGN PATENT DOCUMENTS

JP 2014176633 A 9/2014
WO WO2010048203 A1 4/2010
WO WO-2014033396 A1 * 3/2014 ..... A43C 11/008

*Primary Examiner* — Sharon M Prange
(74) *Attorney, Agent, or Firm* — Quinn IP Law

(57) ABSTRACT

A sole structure for an article of footwear comprises a unitary midsole having a first portion and a second portion rearward of the first portion. A bottom surface of the unitary midsole defines a groove extending from a medial side to a lateral side of the unitary midsole, and a top surface of the unitary midsole defines a slit disposed over the groove and extending from the medial side to the lateral side. The unitary midsole forms a living hinge at the groove and the slit, with the living hinge connecting the first portion to the second portion so that the first portion and the second portion are selectively pivotable relative to one another at the living hinge between a first orientation and a second orientation. The groove is wider in the first orientation than in the second orientation, and the slit is wider in the second orientation.

13 Claims, 12 Drawing Sheets

Related U.S. Application Data

(60) Provisional application No. 62/413,037, filed on Oct. 26, 2016.

(51) Int. Cl.
*A43C 1/00* (2006.01)
*A43B 23/02* (2006.01)
*A43B 13/14* (2006.01)

(52) U.S. Cl.
CPC ..... *A43B 23/0245* (2013.01); *A43B 23/0295* (2013.01); *A43C 1/00* (2013.01)

(58) Field of Classification Search
USPC ..... 36/58.6, 97, 105
See application file for complete search history.

(56) References Cited

U.S. PATENT DOCUMENTS 2,825,155 A 3/1958 Hines
4,776,111 A 10/1988 Crowley
5,152,082 A 10/1992 Culpepper
5,184,410 A * 2/1993 Hamilton ..... A43B 1/0045 36/103
5,481,814 A * 1/1996 Spencer ..... A43B 7/00 36/103
5,884,420 A 3/1999 Donnadieu
6,189,239 B1 * 2/2001 Gasparovic ..... A43B 3/30 36/102
6,964,119 B2 11/2005 Weaver, III
7,607,242 B2 * 10/2009 Karandonis ..... A43B 1/0081 36/105
7,685,747 B1 * 3/2010 Gasparovic ..... A43C 11/002 36/102
8,006,410 B2 8/2011 Romboli et al.
8,539,698 B1 9/2013 Woodruff
8,769,845 B2 * 7/2014 Lin ..... A43B 23/027 36/138
10,159,310 B2 12/2018 Sullivan
2008/0168683 A1 7/2008 Keating
2010/0251572 A1 * 10/2010 Baudouin ..... A43B 11/00 36/103
2014/0310992 A1 * 10/2014 Shalom ..... A43B 3/246 36/103
2015/0020416 A1 * 1/2015 Wiens ..... A43B 23/0295 36/102
2015/0047227 A1 2/2015 Fallon et al.
2018/0263332 A1 * 9/2018 Bruno ..... A43B 13/188

* cited by examiner

HINGED FOOTWEAR SOLE STRUCTURE FOR FOOT ENTRY AND METHOD OF MANUFACTURING

CROSS-REFERENCE TO RELATED APPLICATION

This application is a divisional of and claims the benefit of priority to U.S. application Ser. No. 15/792,059, filed Oct. 24, 2017, which claims the benefit of priority to U.S. Provisional Application No. 62/413,037, filed Oct. 26, 2016, each of which is hereby incorporated by reference in its entirety.

TECHNICAL FIELD

The present teachings generally include a sole structure for an article of footwear, an article of footwear, and a method of manufacturing an article of footwear.

BACKGROUND

Traditionally, placing footwear on a foot often requires the use of one or both hands to stretch the ankle opening of a footwear upper, and hold the rear portion during foot insertion. The fit of the upper is then adjusted following foot insertion, such as by tying laces.

DESCRIPTION

Figure 1:
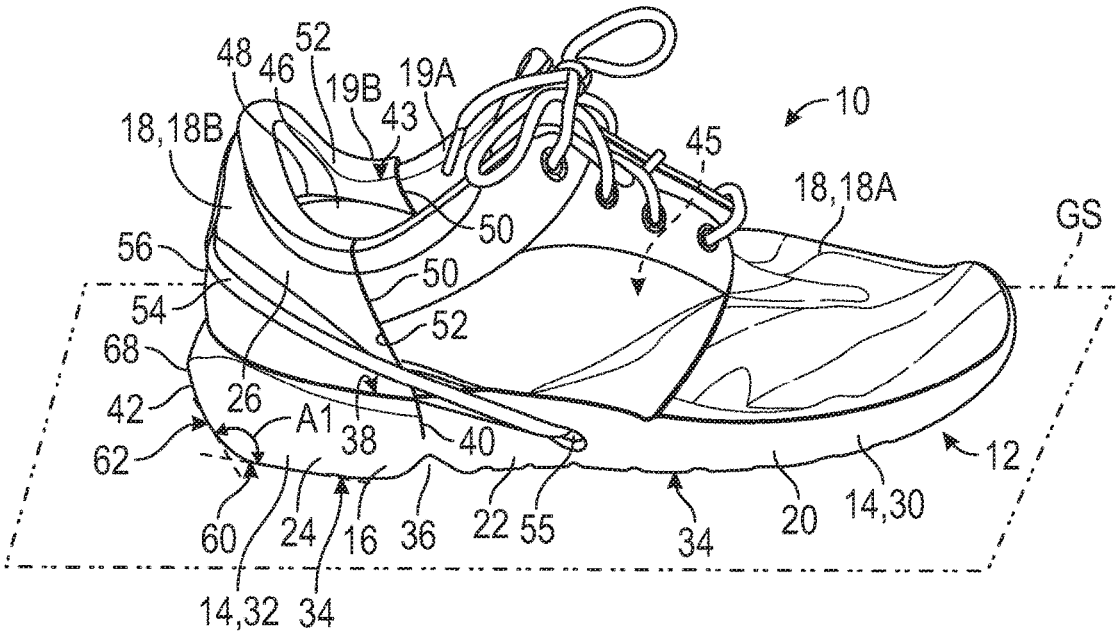
FIG. 1 is a schematic illustration in perspective view of a lateral side of an embodiment of an article of footwear in a use position.

A sole structure for an article of footwear enables hands-free placement of the article of footwear on a foot. The sole structure comprises a unitary midsole having a first portion and a second portion rearward of the first portion. A bottom surface of the unitary midsole defines a groove extending from a medial side to a lateral side of the unitary midsole. A top surface of the unitary midsole defines a slit disposed over the groove and extending from the medial side to the lateral side. The unitary midsole forms a living hinge at the groove and the slit, with the living hinge connecting the first portion to the second portion so that the first portion and the second portion are selectively pivotable relative to one another at the living hinge between a first orientation and a second orientation. The groove is wider in the first orientation than in the second orientation, and the slit is wider in the second orientation than in the first orientation.

In one or more embodiments, the slit is closed and the groove is open in the first orientation, and the slit is open and the groove is closed in the second orientation. Additionally, in one or more embodiments, the slit includes a main portion, a front branch, and a rear branch, such as in a Y-formation. The front branch extends downward from the top surface of the unitary midsole toward the groove and has a distal end spaced above the groove. The front branch extends from the distal end of the main portion into the first portion and terminates above the bottom surface. The rear branch extends from the distal end of the main portion into the second portion and terminates above the bottom surface. In such an embodiment, the unitary midsole may have a front wall and a rear wall in the bottom surface at the groove, the front branch of the slit may extend above the front wall, and the rear branch of the slit may extend above the rear wall.

In one or more embodiments, the first portion of the unitary midsole includes a forefoot region and a midfoot region, the second portion of the unitary midsole includes a heel region. The bottom surface of the unitary midsole in the heel region has a main portion and a rearmost portion extending from and disposed at an obtuse angle to the main portion. The main portion of the bottom surface extends along a horizontal plane in the first orientation, and the rearmost portion of the bottom surface extends along the horizontal plane in the second orientation.

In one or more embodiments, the top surface of the unitary midsole in the second portion has a main portion and a rearmost portion extending from and disposed at an obtuse angle to the main portion of the top surface so that the second portion of the unitary midsole has a ridge between the rearmost portion of the bottom surface and the rearmost portion of the top surface.

Within the scope of the present teachings, an article of footwear comprises a sole structure having a front sole portion, a rear sole portion, and a living hinge extending transversely across the sole structure from a medial side to a lateral side of the sole structure and connecting the front sole portion to the rear sole portion. The article of footwear further comprises a divided footwear upper including a front upper portion and a separate rear upper portion. The front upper portion is fixed to the front sole portion and defines at least the forefoot region of the footwear upper, and the rear upper portion is fixed to the rear sole portion and defines the heel region of the footwear upper. The front sole portion and the rear sole portion are selectively pivotable relative to one another at the living hinge between a use position and an access position. In the use position, the front upper portion and the rear upper portion together define a foot-receiving cavity and an ankle opening, and the rear upper portion overlaps the front upper portion at a medial side of the sole structure and at a lateral side of the sole structure. In the access position, the front upper portion and the rear upper portion are spaced apart from one another so that the ankle opening is larger than in the use position. Accordingly, the article of footwear with the divided upper portion may enable hands-free foot entry in the access position, while the overlapping front and rear upper portions provide lateral stability to the upper in the use position.

In one or more embodiments, the rear upper portion includes an elastic biasing member that extends along a medial side of the article of footwear and a lateral side of the article of footwear and is secured to the article of footwear forward of the living hinge. Stated differently, the rear upper portion itself is the elastic biasing member. Alternatively, in one or more embodiments, the elastic biasing member may be separate from the rear upper portion, and extends along a medial side of the article of footwear and a lateral side of the article of footwear and around a rear periphery of the rear upper portion, and is secured to the article of footwear forward of the living hinge.

In one or more embodiments of the article of footwear, the front upper portion includes a heel footbed. A rear periphery of the heel footbed is surrounded by the rear upper portion and overlays the rear sole portion in the use position, and the heel footbed is disposed further away from the rear upper portion when the front sole portion and the rear sole portion are in the access position than when in the use position. The interfitting of the heel footbed of the front upper portion with the rear upper portion in the use position helps further stabilize the divided upper when in the use position.

Alternatively, a heel footbed can be an integral part of the front sole portion. For example, in one or more embodiments of the article of footwear, the front sole portion includes a heel footbed, a rear periphery of the heel footbed is surrounded by the rear upper portion and overlays the rear sole portion in the use position. The heel footbed is disposed further away from the rear upper portion when the front sole portion and the rear sole portion are in the access position than when in the use position.

In one or more embodiments of the article of footwear, the rear upper portion includes a compliant protrusion that protrudes forward into the foot-receiving cavity above the heel footbed when the front sole portion and the rear sole portion are in the use position. The compliant protrusion further stabilizes the divided upper in the use position as it provides at least some resistance to the heel footbed moving past the compliant protrusion out of the foot-receiving cavity. Additionally, the compliant protrusion may enable the upper to securely fit to a wider range of ankle girths.

In one or more embodiments of the article of footwear, the front sole portion, the rear sole portion, and the living hinge are coplanar in the use position, and the sole structure is lifted at the living hinge in the access position relative to the use position so that the rear sole portion inclines from a rear end of the rear sole portion to the living hinge, and the front sole portion inclines from a forward end of the front sole portion to the living hinge. In the access position, the front sole portion and the opening of the foot receiving cavity of the front upper portion are thus angled upward for easy foot insertion, such as with the foot entering toes first at a downward and forward angle.

In one or more embodiments of the article of footwear, the article of footwear further comprises a cinching system for tightening the upper in the use position. The cinching system includes at least one cable extending at least partially over the front upper portion and secured to the rear sole portion at one of the medial side or the lateral side of the sole structure, and a pulley secured to the front sole portion at the same one of the medial side or the lateral side of the sole structure. The cable is relatively slack when the front sole portion and the rear sole portion are in the access position, and is relatively taut when the front sole portion and the rear sole portion are in the use position. The cinching system automatically tightens as the sole structure moves to the use position from the access position.

In one or more embodiments of the article of footwear, the at least one cable has a first end secured to the rear sole portion at the medial side of the sole structure, and a second end secured to the rear sole portion at the lateral side of the sole structure. The pulley is a first pulley secured to the front sole portion at the medial side of the sole structure. The at least one cable extends around the first pulley between the first end of the at least one cable and the second end of the at least one cable. The cinching system further comprises a second pulley secured to the front sole portion at the lateral side of the sole structure. The at least one cable extends around the second pulley between the first end of the at least one cable and the second end of the at least one cable.

In one or more embodiments of the article of footwear, the front upper portion includes a heel footbed, and a rear periphery of the heel footbed is surrounded by the rear upper portion and overlays the rear sole portion in the use position. The heel footbed is disposed further away from the rear upper portion when the front sole portion and the rear sole portion are in the access position than when in the use position. The article of footwear further comprises a strap having a fixed end secured to the heel footbed and a free end extending through an aperture in the rear upper portion. The strap has a length configured so that the strap is slack when the sole structure is in the access position, and the front upper portion is pivoted toward the use position when the strap is pulled taut by the free end.

In one or more embodiments of the article of footwear, the sole structure is a unitary midsole, a bottom surface of the unitary midsole defines a groove extending from the medial side to the lateral side of the sole structure, and a top surface of the unitary midsole defines a slit disposed over the groove and extending from the medial side to the lateral side. The unitary midsole forms the living hinge at the groove and the slit, with the groove wider in the first orientation than in the second orientation, and with the slit wider in the second orientation than in the first orientation.

Within the scope of the present teachings, an article of footwear comprises a midsole having a front midsole portion, a rear midsole portion, and a living hinge extending transversely across the midsole from a medial side of the midsole to a lateral side of the midsole and connecting the front midsole portion to the rear midsole portion. The article of footwear includes a divided footwear upper including a front upper portion and a separate rear upper portion. The front upper portion is fixed to the front midsole portion and defines at least a forefoot region of the footwear upper, and the rear upper portion is fixed to the rear midsole portion and defines a heel region of the footwear upper. The front midsole portion and the rear midsole portion are selectively pivotable relative to one another at the living hinge between a use position and an access position. The midsole is lifted at the living hinge in the access position relative to the use position so that the rear midsole portion inclines from a rear end of the rear midsole portion to the living hinge, and the front midsole portion inclines from a forward end of the front midsole portion to the living hinge. A bottom surface of the midsole in the heel region has a main portion and a rearmost portion extending from and disposed at an obtuse angle to the main portion. The main portion of the bottom surface rests on a horizontal ground surface in the use position, and the rearmost portion of the bottom surface rests on the horizontal ground surface in the access position. Accordingly, the level nature of the rearmost portion of the bottom surface of the midsole provides stability when the midsole rests on the rearmost portion of the bottom surface in the access position prior to foot entry.

In one or more embodiments of the article of footwear, the top surface of the rear midsole portion has a main portion and a rearmost portion extending from and disposed at an obtuse angle to the main portion so that the rear midsole portion has a ridge between the rearmost portion of the bottom surface and the rearmost portion of the top surface.

In one or more embodiments of the article of footwear, the rear upper portion includes an elastic biasing member that extends along a medial side of the article of footwear and a lateral side of the article of footwear and is secured to the article of footwear forward of the living hinge. In such embodiments, the rear upper portion serves also as the elastic biasing member. Alternatively, an elastic biasing member may be separate from the rear upper portion, and may extend around a rear periphery of the rear upper portion and along a medial side of the article of footwear and a lateral side of the article of footwear, and may be secured to the article of footwear forward of the living hinge and extend.

A method of manufacturing footwear such as the articles of footwear described herein comprises forming a midsole having a front midsole portion, a rear midsole portion, and a living hinge that extends transversely across the midsole from a medial side of the midsole to a lateral side of the midsole and connects the front midsole portion and the rear midsole portion. In one or more embodiments, forming the midsole includes molding the midsole by one of compression molding or injection molding. Molding the midsole may include molding a bottom surface of the midsole with a groove extending from a medial side of the midsole to a lateral side of the midsole, the groove at least partially establishing the living hinge. As such, the living hinge is integral with the front and rear midsole portions as a one-piece, molded component. Forming the midsole with the living hinge by molding is simpler and may be less time consuming than manufacturing sole structures with hinges that are comprised of multiple interconnected and separately formed components.

In one or more embodiments of the method of manufacturing footwear, molding the midsole includes molding a bottom surface of the rear midsole portion to have a main portion and a rearmost portion extending from and disposed at an obtuse angle to the main portion. Accordingly, the rearmost portion on which the footwear rests in the access position may be efficiently molded into the midsole rather than provided by cutting the midsole in a separate step after forming the midsole.

In one or more embodiments of the method of manufacturing footwear, molding the unitary midsole includes molding a top surface of the midsole with a slit that extends from the medial side of the midsole to the lateral side of the midsole above the groove, the slit partially establishing the living hinge. Molding the top surface of the midsole with the slit is contemporaneous with molding the bottom surface of the midsole with the groove.

In one or more embodiments of the method of manufacturing footwear, the method may comprise providing a slit in a top surface of the midsole by hot knife cutting or laser cutting, with the slit extending from the medial side of the midsole to the lateral side of the midsole and disposed over the groove. The hot knifing cutting or laser cutting is carried out subsequent to molding of the unitary midsole.

In one or more embodiments of the method of manufacturing footwear, the method comprises providing a groove in a bottom surface of the unitary midsole by hot knife cutting or laser cutting. The groove extends from a medial side of the unitary midsole to a lateral side of the unitary midsole. The hot knifing cutting or laser cutting is carried out subsequent to molding of the unitary midsole.

In one or more embodiments of the method of manufacturing footwear, the method further comprises securing a front upper portion to the front midsole portion, and securing a rear upper portion to the rear midsole portion. The rear upper portion is divided from the front upper portion.

In one or more embodiments of the method of manufacturing footwear, the method further comprises securing an elastic biasing member to the article of footwear forward of the living hinge so that the elastic biasing member extends along a medial aide and a lateral side of the article of footwear and around a rear periphery of the rear upper portion.

In one or more embodiments of the method of manufacturing footwear, the method further comprises attaching a strap to a heel footbed of the front upper portion, and extending a free end of the strap through an aperture in the rear upper portion.

In one or more embodiments of the method of manufacturing footwear, the method further comprises securing a pulley to the front midsole portion at one of the medial side of the midsole or the lateral side of the midsole, and securing at least one cable to the rear midsole portion at said one of the medial side of the midsole or the lateral side of the midsole. The at least one cable extends around the pulley and at least partially over the front upper portion. The at least one cable and the pulley are arranged so that the upper is automatically tightened when the midsole pivots to the use position from the access position.

The above features and advantages and other features and advantages of the present teachings are readily apparent from the following detailed description of the modes for carrying out the present teachings when taken in connection with the accompanying drawings.

Figure 2:
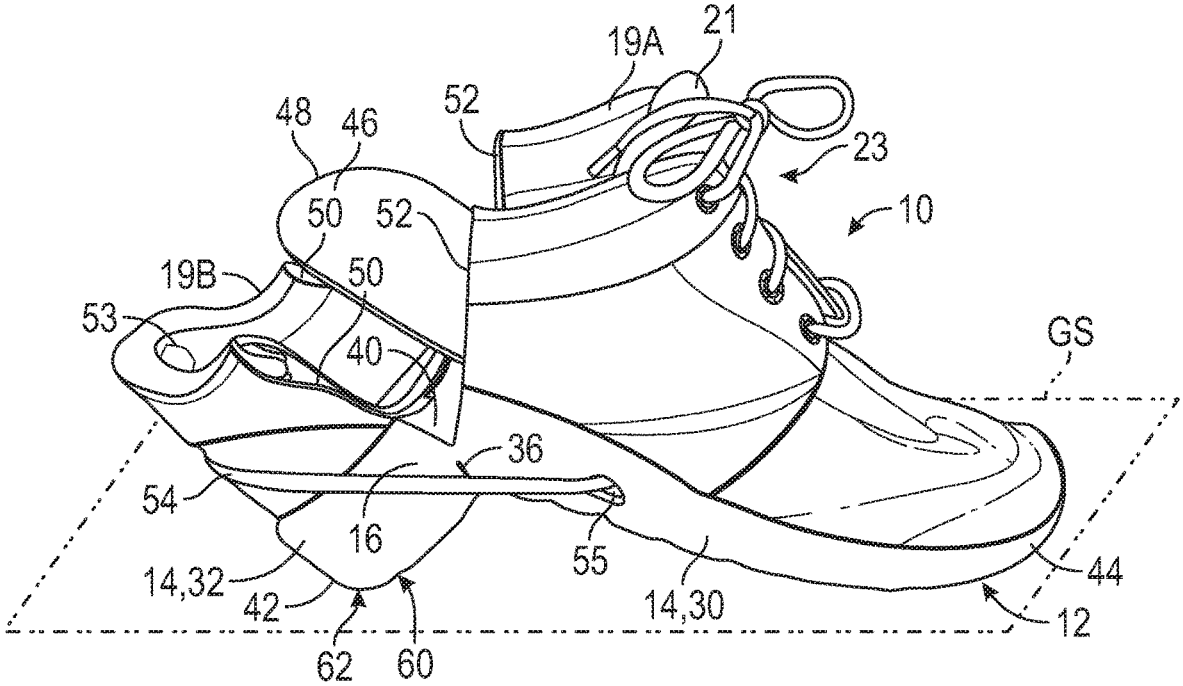
FIG. 2 is a schematic illustration in perspective view of the lateral side of the article of footwear of FIG. 1 in an access position.
Figure 3:
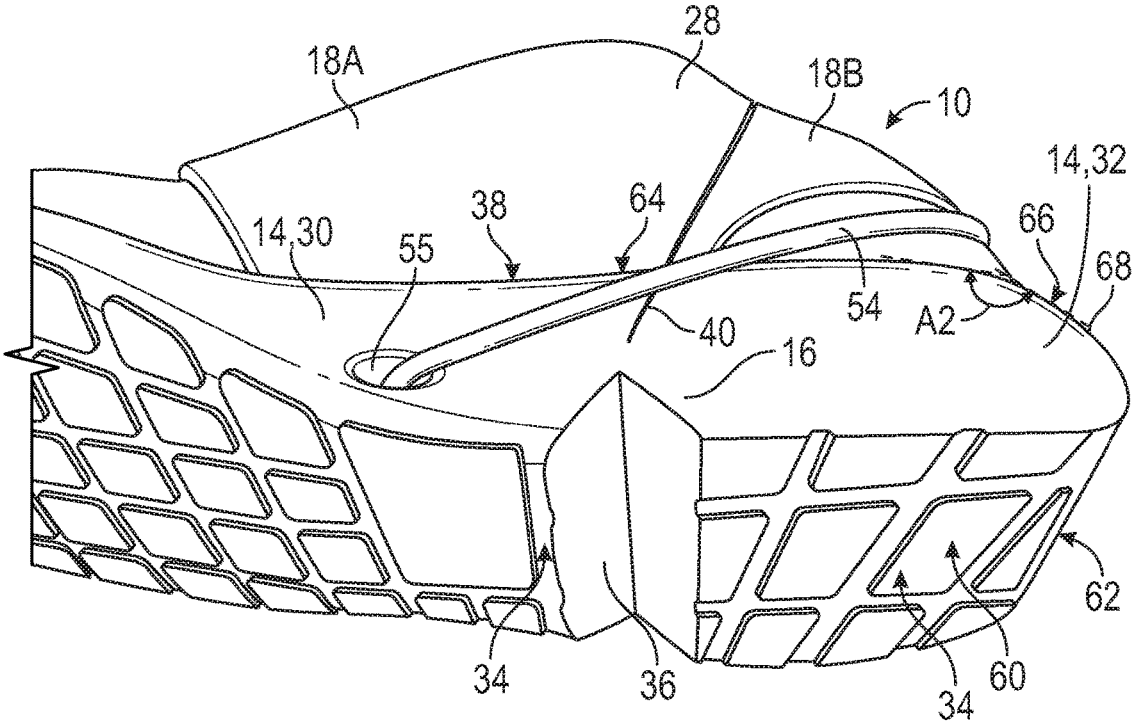
FIG. 3 is a schematic illustration in fragmentary perspective view of the bottom of the midsole of the article of footwear of FIG. 1 in the use position.

Referring to the drawings, wherein like reference numbers refer to like components throughout the views, FIGS. 1-3 show an embodiment of an article of footwear 10 (also referred to herein as footwear 10) that includes a sole structure 12 with a unitary midsole 14 that includes a living hinge 16. As used herein, a "living hinge" is flexible hinge that is integral with two adjacent portions of a component that it hingedly connects and, in some embodiments, is made from the same material as the adjacent portions of the component. The article of footwear 10 also includes a divided footwear upper 18. As discussed herein, these and other features of the article of footwear 10 enable an access position of the footwear (such as shown in FIG. 2) that affords easy, hands-free foot entry into the article of footwear 10, which adopts a use position (such as shown in FIG. 1) after foot entry, also in a hands-free manner. The footwear herein is depicted as leisure shoes and athletic shoes, but the present teachings also include an article of footwear that is a dress shoe, a work shoe, a sandal, a slipper, a boot, or any other category of footwear.

As indicated in FIG. 1, the footwear 10 may be divided into three general regions: a forefoot region 20, a midfoot region 22, and a heel region 24 which are also the forefoot region, the midfoot region, and the heel region, respectively, of the midsole 14 and the upper 18. The footwear 10 also includes a lateral side 26 and a medial side 28 (best shown in FIG. 3) opposite to the lateral side 26. The forefoot region 20 generally includes portions of the article of footwear 10 corresponding with the toes and the joints connecting the metatarsals with the phalanges. The midfoot region 22 generally includes portions of the article of footwear 10 corresponding with the arch area of the foot, and the heel region 24 corresponds with rear portions of the foot, including the calcaneus bone. The lateral side 26 and medial side 28 extend through each of forefoot region 20, the midfoot region 22, and the heel region 24 and correspond with opposite sides of the article of footwear 10. The forefoot region 20, the midfoot region 22, the heel region 24, the lateral side 26 and the medial side 28 are not intended to demarcate precise areas of footwear 10, but are instead intended to represent general areas of footwear 10 to aid in the following discussion.

The unitary midsole 14 is depicted as a single, one-piece midsole, including the living hinge 16, but in other embodiments could be multiple components integrated as a unit. The midsole 14 may be integrated with outsole components as a unisole. For example, the outsole components may be traction elements formed from a wear-resistant rubber material that may be textured to impart traction and/or may include traction elements such as cleats secured to a bottom surface 34 of the midsole 14. The midsole 14 may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, the midsole 14 may incorporate fluid-filled chambers, plates, moderators, or other elements that further attenuate forces, enhance stability, or influence the motions of the foot.

The unitary midsole 14 has a first portion 30 and a second portion 32 rearward of the first portion 30. The first portion 30 is also referred to as a front sole portion or a front midsole portion 30, and the rear portion 32 is also referred to as a rear sole portion or a rear midsole portion 32. The front midsole portion 30 of the unitary midsole 14 includes the forefoot region 20 and the midfoot region 22 of the midsole 14, and the rear midsole portion 32 of the unitary midsole 14 includes the heel region 24. In order to establish a living hinge 16 in the unitary midsole 14, a bottom surface 34 of the unitary midsole 14 defines a groove 36 extending from the medial side 28 to the lateral side 26, as best shown in FIG. 3. The unitary midsole 14 has a top surface 38 opposite to the bottom surface 34. The bottom surface 34 generally serves as the ground contact surface during wear of the article of footwear 10. The top surface 38 generally faces away from the bottom surface 34, and may be referred to as a foot-facing surface as it generally faces the foot supported above it. The top surface 38 defines a slit 40 disposed over the groove 36 but not extending to the groove, and extending from the medial side 28 to the lateral side 26.

The unitary midsole 14 forms the living hinge 16 at the groove 36 and the slit 40, with the living hinge 16 connecting the first portion 30 to the second portion 32 and extending transversely across the midsole 14 from the medial side 28 to the lateral side 26. The first portion 30 and the second portion 32 are selectively pivotable relative to one another at the living hinge 16. For example, FIG. 1 shows the footwear 10 in a first orientation, also referred to as a use position, and FIG. 2 shows the footwear 10 in a second orientation, also referred to as an access position. The first portion 30 and the second portion 32 are pivotable relative to one another at the living hinge 16 between the first orientation and the second orientation. The groove 36 is wider in the first orientation than in the second orientation, and the slit 40 is wider in the second orientation than in the first orientation. Because the living hinge 16 is an integral portion of the one-piece midsole and seamlessly connects the first portion and the second portion, rather than being one or more additional separate components positioned between and securing two discrete front and rear midsole components, the unitary midsole 14 may be lighter and easier to manufacture than other hinged sole structures.

As illustrated in FIG. 1, in the use position, the front midsole portion 30, the living hinge 16, and the rear midsole portion 32 are generally coplanar in a plane parallel to the plane shown in phantom representing the ground surface GS. As indicated in FIG. 2, the unitary midsole 14 is lifted at the living hinge 16 in the access position relative to the use position (FIG. 1) so that the rear midsole portion 32 inclines from a rear end 42 of the rear midsole portion 32 to the living hinge 16, and the front midsole portion 30 inclines from a forward end 44 of the front midsole portion 30 to the living hinge 16.

To facilitate pivoting of the footwear 10 at the living hinge 16 and hands-free foot entry, the footwear 10 includes a divided footwear upper 18. The upper 18 includes a front upper portion 18A and a separate rear upper portion 18B. The upper 18 is referred to as divided because the front upper portion 18A and the rear upper portion 18B are separate, discreet upper components that are not physically connected to one another. The front upper portion 18A is fixed to the front midsole portion 30 and defines at least the forefoot region 20 of the footwear upper 18. In the embodiment shown, the front upper portion 18A also defines the midfoot region 22. The rear upper portion 18B is fixed to the rear midsole portion 32 and defines the heel region 24 of the footwear upper. The living hinge 16 is at the divide between the front upper portion 18A and the rear upper portion 18B.

Additionally, the front upper portion 18A may include a heel footbed 46 extending rearward from the remainder of the front upper portion 18A. A rear periphery 48 of the heel footbed 46 is surrounded by the rear upper portion 18B and overlays the rear midsole portion 32 in the use position shown in FIG. 1. The top surface 38 at the rear midsole portion 32 may be slightly recessed to receive the heel footbed 46 which has a width less than the width between the two side walls of the rear upper portion 18B. The heel footbed 46 is within the foot-receiving cavity 45 formed by the upper portions 18A, 18B in the use position. In the access position of FIG. 2, the heel footbed 46 is exposed above the rear midsole portion 32, and disposed further away from the rear upper portion 18B than when in the use position. In the embodiment shown, the heel footbed 46 may be an integral portion of the front upper portion 18A. In other embodiments, the heel footbed 46 may be an integral portion of the front midsole portion 30. In still other embodiments, there may be no heel footbed 46 that extends from the front upper portion 18A. Instead, each of the front and rear midsole portions 30, 32 would have discrete footbed portions.

In the use position, the front upper portion 18A and the rear upper portion 18B are generally contiguous as a forward edge 50 of the rear upper portion 18B contacts or is at least substantially adjacent to a rear edge 52 of the front upper portion 18A at both the medial side 28 and the lateral side 26. The front upper portion 18A and the rear upper portion 18B define an ankle opening 43 that leads into a foot-receiving cavity 45 in which a wearer's foot is supported and secured during use of the footwear 10. In the use position, the size of the ankle opening 43 is determined by a front collar portion 19A and a rear collar portion 19B of the contiguous upper portions 18A, 18B. The footwear 10 has a tongue 21 and a lacing system 23. The lacing system 23 may be adjusted to vary the size of the ankle opening 43 in the use position. However, due to the ability of the footwear 10 to be selectively pivoted to the access position, and to remain in the access position until use is desired, the lacing system 23 may be initially adjusted to a desired tightness to obtain a desired fit in the use position, and then left at the initially set tightness during subsequent cycles of placement of the footwear 10 on the foot for use and removal of the footwear 10 from the foot.

In the access position of FIG. 2, the front upper portion 18A and the rear upper portion 18B are discontinuous with the forward edge 50 and the rearward edge 52 significantly spaced apart from one another. In the access position, the front collar portion 19A and the rear collar portion 19B are separated due to the discontinuity of the upper portions 18A, 18B, widening the ankle opening substantially. In fact, due to the incline of the front upper portion 18A presented in the access position with the rear upper portion 18B disposed entirely below the entry angle for the front upper portion 18A, a foot can slide forward into the foot-receiving cavity 45 at the front upper portion 18A with the toes entering at a downward and forward trajectory, using the heel footbed 46 as a guide, and without a need to stretch, open, shift, or otherwise displace any portion of the footwear 10. When the foot is inserted into the front upper portion 18A and weight is placed on the front midsole portion 30, the front midsole portion 30 is urged to return to the use position, and the rear midsole portion 32 also returns to the use position causing the rear upper portion 18B to surround a rear portion of the foot, capturing the foot within the foot-receiving cavity 45.

The rear upper portion 18B may include a compliant protrusion 53 (best shown in FIG. 2) that protrudes forward into the foot-receiving cavity 45 above the heel footbed 46 when the front midsole portion 30 and the rear midsole portion 32 are in the use position of FIG. 1. The protrusion 53 may be, for example, a bulge of foam padding at the inner periphery of the rear upper portion 18B just under the rear collar portion 19B. The protrusion 53 can be configured to help trap the heel footbed 46 below the protrusion 53, and also provides enough compliance to permit the footbed 46 to move past the protrusion 53 when moving to the access position, and so that the rear upper portion 18B comfortably secures to ankles of different girths.

An elastic biasing member 54 extends along the medial side 28 and the lateral side 26 of the article of footwear 10 and around a rear periphery 56 of the rear upper portion 18B. The elastic biasing member 54 can be any resiliently stretchable material, such as rubber or elastic nylon. The elastic biasing member 54 is secured to the front midsole portion 30 forward of the living hinge 16. The elastic biasing member 54 is shown at the lateral side 26 in FIG. 1, and at the medial side 28 in FIG. 3. The elastic biasing member 54 loops around the rear periphery 56 of the rear upper portion 18B. The front midsole portion 30 has recesses 55 that are openings of a transverse channel in the front midsole portion 30 at the lateral side 26 and the medial side 28, and the elastic biasing member 54 may extend through the channel and may be a continuous loop. Alternatively, the elastic biasing member 54 may have opposite ends that secure to the medial side 28 and the lateral side 26 of the front midsole portion 30, respectively. In still other embodiments, the elastic biasing member 54 can be secured to article of footwear 10 between the front midsole portion 30 and the front upper portion 18A. For example, the elastic biasing member 54 can be stitched to the front upper portion 18A at a lower region of the front upper portion 18A that is then secured to the upper surface 38 of the front midsole portion 30. As another alternative, the elastic biasing member 54 could pass under the bottom surface 34 of the front midsole portion 30 (and under any outsole or outsole elements that may be secured thereto). In each alternative, the elastic biasing member 54 secures to the article of footwear 10 forward of the living hinge 16 at an anchor location that causes a portion of the elastic biasing member 54 that is in tension to cross over or close to the living hinge 16 so that the living hinge 16 is a bi-stable living hinge (i.e., stable in both the use position and the access position). The elastic biasing member 54 is of a length such that it is in tension when in the use position in order to keep the upper portions 18A, 18B contiguous during wear, and is also in tension when the footwear 10 is in the access position of FIG. 2, in order to maintain the footwear in the access position, ready for foot entry. The tension of the elastic biasing member 54 is overcome when a foot loads the footwear 10, so that the elastic biasing member 54 is stretched during a transition from the access position to the use position.

The article of footwear 10 is configured to stably balance on a horizontal surface and remain in the access position awaiting foot entry. More specifically, the bottom surface 34 of the unitary midsole 14 in the heel region 24 has a main portion 60 and a rearmost portion 62 extending from and disposed at an obtuse angle A1 to the main portion 60 so that the main portion 60 of the bottom surface 34 extends along a horizontal plane in the first orientation (i.e., the use position), and the rearmost portion 62 of the bottom surface 34 extends along the horizontal plane in the second orientation (i.e., the access position). For example, the obtuse angle A1 may be the same as angle A of the groove 36 in the use position. Assuming the main portion 60 is level in the use position, then when the groove is closed in the access position, the rearmost portion 62 will be level. The horizontal plane GS is indicated in phantom in FIGS. 1 and 2 and represents a horizontal ground surface. Accordingly, the article of footwear 10 rests on the main portion 60 in the use position, and rests on the rearmost portion 62 in the access position.

The article of footwear 10 is also configured to facilitate hands-free removal. With reference to FIG. 3, the top surface 38 of the second portion 32 of the unitary midsole 14 has a main portion 64 and a rearmost portion 66 extending from and disposed at an obtuse angle A2 to the main portion 64 so that the second portion 32 has a ridge 68 (see FIG. 1 or FIG. 3) between the rearmost portion 62 of the bottom surface 34 and the rearmost portion 66 of the top surface 38. The rearmost portion 66 extending to the ridge 68 protrudes sufficiently to allow an opposite foot to place a downward load thereon, causing the midsole 14 to pivot at the hinge 16, moving the footwear 10 to the access position, which also serves as a removal position that enables hands-free withdrawal of the foot from the foot-receiving cavity 45.

FIGS. 4-10 depict another embodiment of an article of footwear 110 within the scope of the present teachings. The article of footwear 110 has many of the same features as the article of footwear 10, some of which are indicated with like reference numbers. The description of the corresponding features of the article of footwear 10 applies equally to the article of footwear 110. For example, the article of footwear 10 has a sole structure 112 with a midsole 114 that is depicted as a unitary, one-piece midsole, including the living hinge 16, but in other embodiments could be multiple components integrated as a single unit.

The unitary midsole 114 has a first portion 130 and a second portion 132 rearward of the first portion 130. The first portion 130 is also referred to as a front sole portion or a front midsole portion 130, and the rear portion 132 is also referred to as a rear sole portion or a rear midsole portion 132. The front midsole portion 130 of the unitary midsole 114 includes the forefoot region 20 and the midfoot region 22 of the midsole 114, and the rear midsole portion 132 of the unitary midsole 114 includes the heel region 24. In order to establish a living hinge 116 in the unitary midsole 14, a bottom surface 134 of the unitary midsole 14 defines a groove 136 extending from the medial side 28 to the lateral side 26. The unitary midsole 114 has a top surface 138 opposite the bottom surface 134. The bottom surface 134 generally serves as the ground contact surface during wear of the article of footwear 110. The top surface 138 generally faces away from the bottom surface 134, and may be referred to as a foot-facing surface as it generally faces the foot supported above it. The top surface 138 defines a slit 140 disposed over the groove 136 and extending from the medial side 28 to the lateral side 26.

Figure 6:
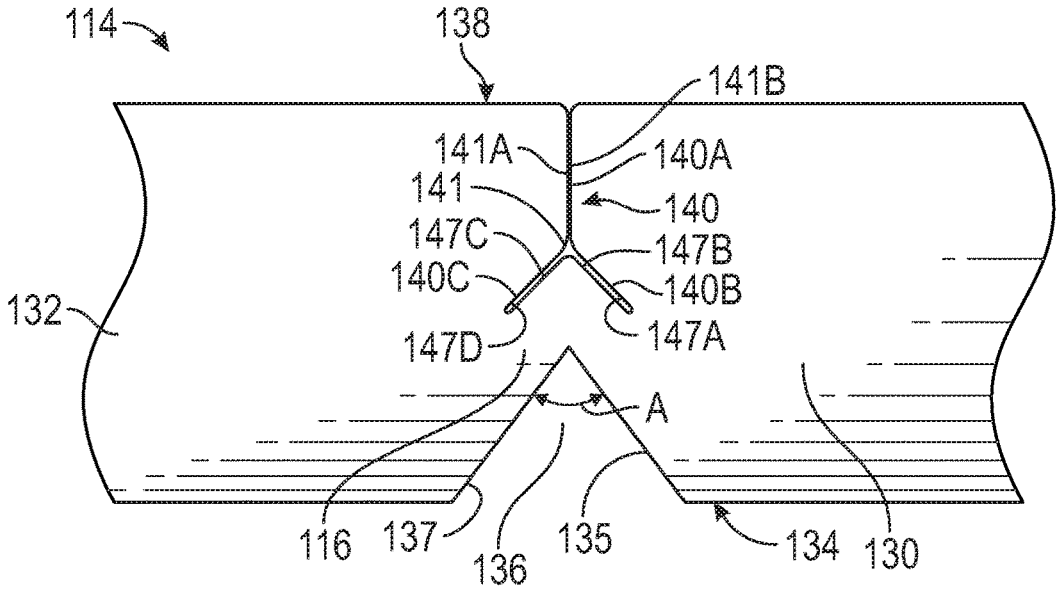
FIG. 6 is a schematic illustration in fragmentary side view of the lateral side of a midsole of the article of footwear of FIG. 4 in the use position showing a living hinge.
Figure 7:
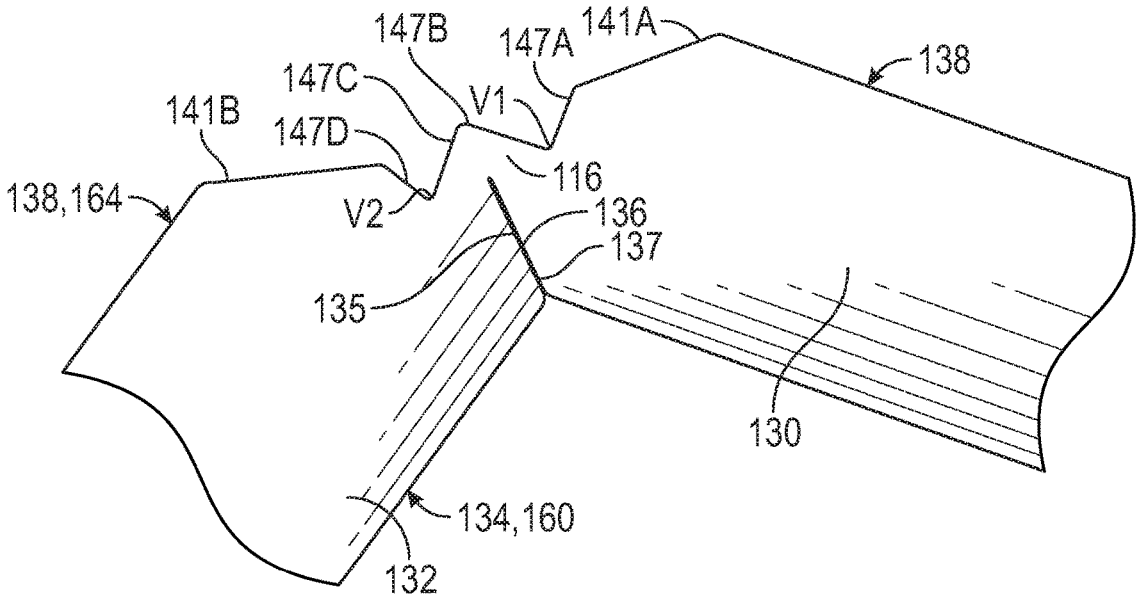
FIG. 7 is a schematic illustration in fragmentary side view of the lateral side of the midsole of FIG. 6 when the article of footwear of FIG. 4 is in an access position.

The living hinge 116 that is alike in all aspects to midsole 14 with living hinge 16 except that the slit 40 of the midsole 14 is replaced with a more complex slit 140. With reference to FIGS. 6 and 7, the slit 140 includes a main portion 140A extending downward from the top surface 138 of the midsole 114 toward the groove 136 and having a distal end 141 spaced above the groove 136 (i.e., stopping short of and not extending all of the way to the groove 136). The slit 140 has a front branch 140B extending from the distal end 141 of the main portion 140A into the front midsole portion 130 and terminating above the bottom surface 134 (i.e., stopping short of and not extending all of the way to the bottom surface 134). The slit 140 also has a rear branch 140C extending from the distal end 141 of the main portion 140A into the rear midsole portion 132 and terminating above the bottom surface 134 (i.e., stopping short of and not extending all of the way to the bottom surface 134).

As is evident in FIG. 6, the unitary midsole 114 has a front wall 135 and a rear wall 137 in the bottom surface 134 at the groove 136. The front branch 140B of the slit 140 extends above the front wall 135, and the rear branch 140C of the slit 140 extends above the rear wall 137. In the embodiment shown, the walls 147A, 147B of the midsole 114 at the front branch 140B are parallel to the front wall 135, and the walls 147C, 147D of the midsole 114 at the rear branch 140C are parallel to the rear wall 137 when the midsole 114 is in the use position of FIG. 6. The branches 140B, 140C of the slit 140 need not be parallel with the walls 135, 137 at the groove 136 in other embodiments, but are configured in all embodiments so that the branches 140B, 140C relieve stress of the midsole 114 at the main portion 140A of the slit 140.

Figure 4:
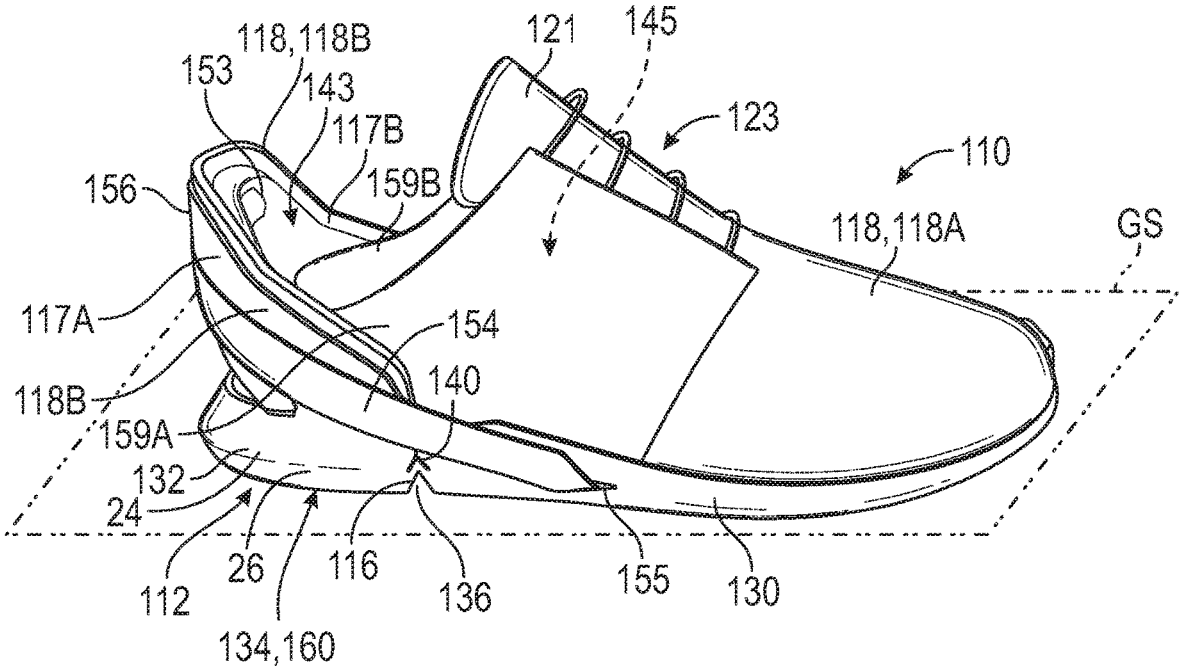
FIG. 4 is a schematic illustration in perspective view of a lateral side of another embodiment of an article of footwear in a use position.
Figure 5:
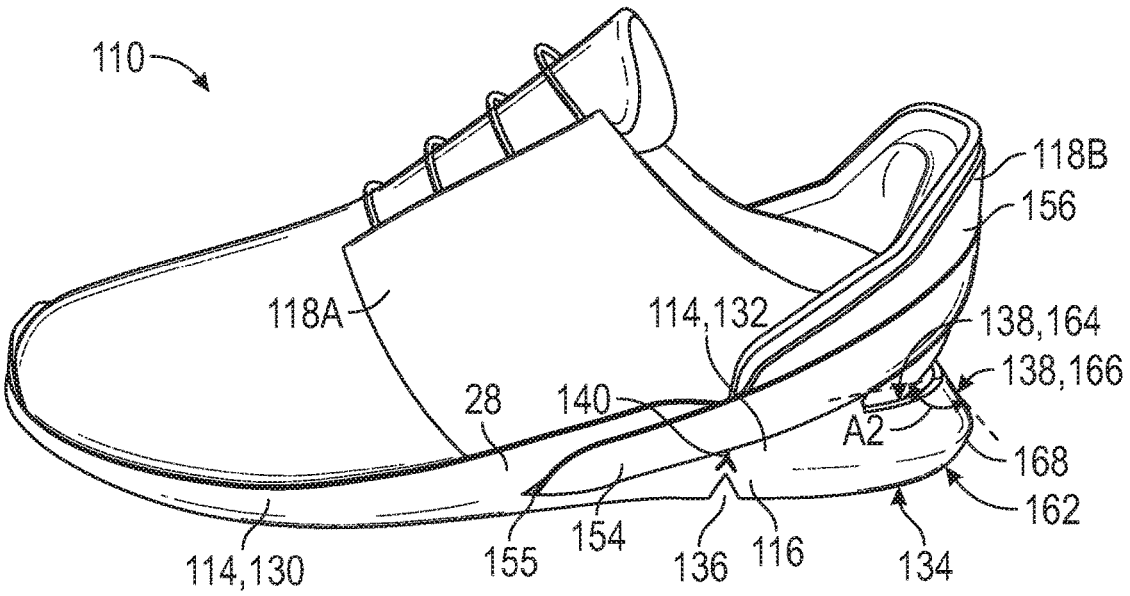
FIG. 5 is a schematic illustration in perspective view of a medial side of the article of footwear of FIG. 4.

The living hinge 116 connects the first portion 130 and the second portion 132 so that the first portion 130 and the second portion 132 are selectively pivotable relative to one another at the living hinge between the first orientation (the use position) of FIGS. 4-6 and a second orientation (the access position) of FIGS. 7-10. As is evident in FIGS. 6-7, the groove 136 is wider in the first orientation than in the second orientation, and the slit 140 is wider in the second orientation than in the first orientation.

The walls 141A, 141B of the midsole 114 at the main portion 140A may be in contact when the footwear 110 is in the use position. The walls 147A, 147B of the front branch 140B may be in contact with one another when the footwear 110 is in the use position. The walls 147C, 147D of the rear branch 140C may be in contact when the footwear 110 is in the use position. The branches 140B, 140C thus provide added surface area at the walls 147A-147D over which compressive forces may be borne. The branches 140B, 140C also allow the slit 140 to open from the Y-shape of FIG. 6 to the W shape of FIG. 7. As is evident in FIG. 7, stress at the living hinge 116 is distributed over two valleys V1 and V2 (which are the distal ends of the branches 140B, 140C) and the material between the valleys V1 and V2, rather than concentrated at a single valley as would be the case with a simple straight slit (e.g., at the end of slit 40 in FIG. 1). The complex slit 140 thus relieves stress at the living hinge 116.

Figure 23:
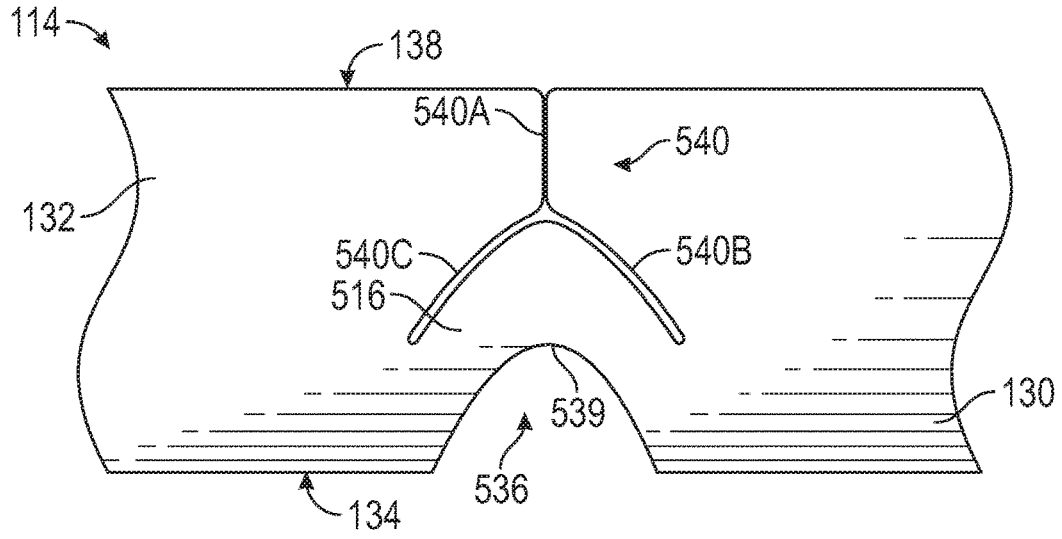
FIG. 23 is a schematic illustration in fragmentary side view of the lateral side of the midsole of the article of footwear of FIG. 4 in the use position with an alternative embodiment of a living hinge.
Figure 24:
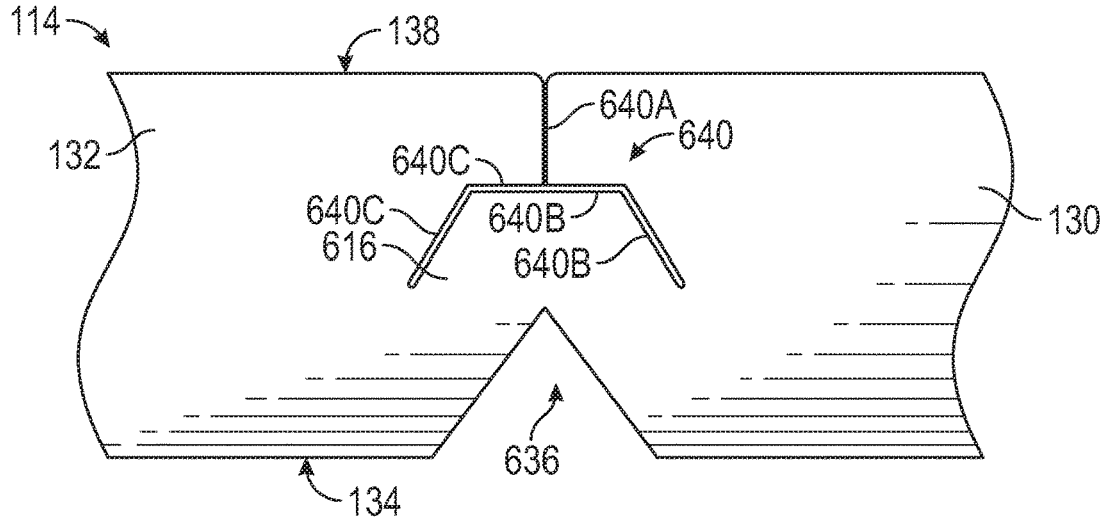
FIG. 24 is a schematic illustration in fragmentary side view of the lateral side of the midsole of the article of footwear of FIG. 4 in the use position with an alternative embodiment of a living hinge.
Figure 25:
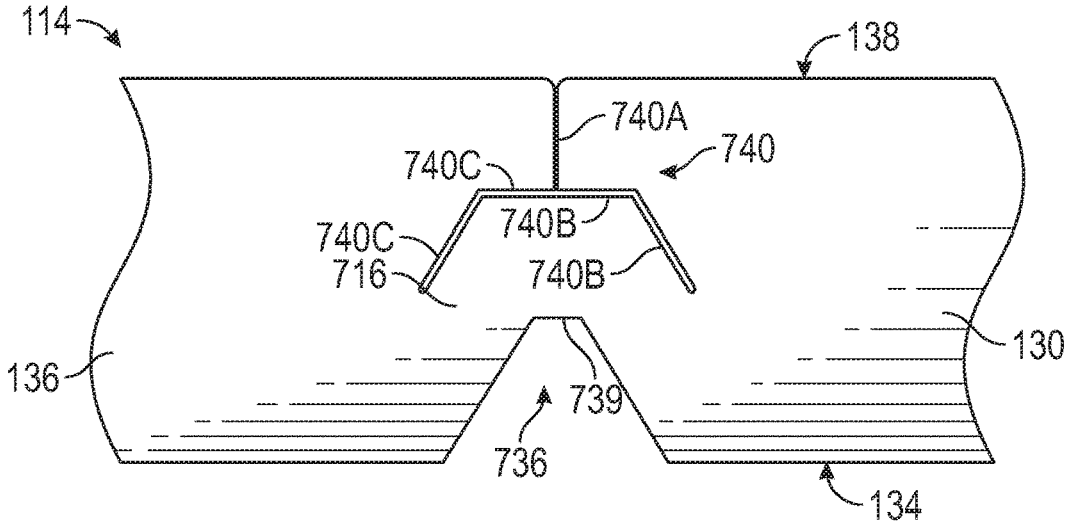
FIG. 25 is a schematic illustration in fragmentary side view of the lateral side of the midsole of the article of footwear of FIG. 4 in the use position with an alternative embodiment of a living hinge.

Other example embodiments of living hinges with complex slits that may be used in the midsole 114 of FIG. 4 in lieu of the slit 140 are illustrated in FIGS. 23-25. FIG. 23 shows a living hinge 516 established by a groove 536 in the bottom surface 134 of the midsole 114 and a complex slit 540 extending from the top surface 138 of the midsole 114 and disposed over the groove 536. The bottom surface 134 of the midsole at the groove 536 has a rounded portion 539 under the slit 540 rather than a V-shaped portion as with the groove 136. The slit 540 includes a main portion 540A, a front branch 540B extending from the distal end of the main portion 140A into the front midsole portion 130 and terminating above the bottom surface 134 of the midsole 114 (i.e., stopping short of and not extending all of the way to the bottom surface 134). The slit 540 also has a rear branch 540C extending from the distal end of the main portion 540A into the rear midsole portion 132 and terminating above the bottom surface 134 of the midsole 114 (i.e., stopping short of and not extending all of the way to the bottom surface 134). The branches 540B, 540C are nonlinear, extending downwardly at a gradually changing slope. The rounded portion 539 and the nonlinear, sloped branches 540B, 540C encourage bending and stress distribution in the region of the living hinge 516 below the branches 540B, 540C and above the groove 536.

FIG. 24 shows a living hinge 616 established by the groove 136 in the bottom surface 134 of the midsole 114 and a complex slit 640 extending from the top surface 138 of the midsole 114 and disposed over the groove 636. The bottom surface 134 of the midsole 114 at the groove 136 has a V-shape as in FIG. 4. The slit 640 includes a main portion 640A, a front branch 640B extending from the distal end of the main portion 640A into the front midsole portion 130 and terminating above the bottom surface 134 of the midsole 114 (i.e., stopping short of and not extending all of the way to the bottom surface 134). The slit 640 also has a rear branch 640C extending from the distal end of the main portion 640A into the rear midsole portion 132 and terminating above the bottom surface 134 of the midsole 114 (i.e., stopping short of and not extending all of the way to the bottom surface 134). The branches 640B, 640C are nonlinear, extending first horizontally and then downwardly at an angle from the horizontal portion. The nonlinear branches 640B, 640C encourage bending and stress distribution in the region of the living hinge 616 below the branches 640B, 640C and above the groove 636.

FIG. 25 shows a living hinge 716 established by a groove 736 in the bottom surface 134 of the midsole 114 and a complex slit 740 extending from the top surface 138 of the midsole 114 and disposed over the groove 736. The bottom surface 134 of the midsole 114 at the groove 736 has straight front and rear walls and a flattened apex 739 between the walls. The slit 740 includes a main portion 740A, a front branch 740B extending from the distal end of the main portion 740A into the front midsole portion 130 and terminating above the bottom surface 134 of the midsole 114 (i.e., stopping short of and not extending all of the way to the bottom surface 134). The slit 740 also has a rear branch 740C extending from the distal end of the main portion 740A into the rear midsole portion 132 and terminating above the bottom surface 134 of the midsole 114 (i.e., stopping short of and not extending all of the way to the bottom surface 134). The branches 740B, 740C are nonlinear, extending first horizontally and then downwardly at an angle from the horizontal portion. The nonlinear branches 740B, 740C encourage bending and stress distribution in the region of the living hinge 716 below the branches 740B, 740C and above the groove 736. The flattened apex 739 helps prevent stress concentrations above the groove 736.

As illustrated in FIGS. 4-6, in the use position, the front midsole portion 130, the living hinge 116, and the rear midsole portion 132 are generally coplanar in a plane parallel to the plane representing the ground surface GS (shown in phantom in FIG. 4). The unitary midsole 114 is lifted at the living hinge 116 in the access position (FIGS. 7-10) relative to the use position (FIGS. 4-6) so that the rear midsole portion 132 inclines from a rear end 142 of the rear midsole portion 132 to the living hinge 116, and the front midsole portion 130 inclines from a forward end 144 of the front midsole portion 130 to the living hinge 116, as best illustrated in FIG. 8.

To facilitate pivoting of the article of footwear 110 at the living hinge 116, the article of footwear 110 has a divided footwear upper 118 with a front upper portion 118A and a rear upper portion 118B. The front upper portion 118A and the rear upper portion 118B are configured differently than front upper portion 18A and rear upper portion 18B in that the rear upper portion 118B overlaps the front upper portion 118A at the medial side 28 and at the lateral side 26 of the footwear 110 when the article of footwear 110 is in the use position, rather than simply abutting at edges as upper portions 18A, 18B abut at edges 50, 52. The front upper portion 118A has a heel footbed 146 best shown in FIG. 10. The heel footbed 146 may be an integral portion of the front upper portion 118A. In other embodiments, the heel footbed 146 may be an integral portion of the front midsole portion 130. A rear periphery 148 of the heel footbed 146 is surrounded by the rear upper portion 118B and overlays the rear midsole portion 132 in the use position shown in FIG. 4. The heel footbed 146 is within the foot-receiving cavity 145 formed by the upper portions 118A, 118B in the use position. The top surface 138 of the rear midsole portion 132 may be slightly recessed to receive the heel footbed 146 which has a width less than the width between the two side walls 117A, 117B of the rear upper portion 118B. In the access position of FIGS. 8-10, the heel footbed 146 is exposed above the rear midsole portion 132, and disposed further away from the rear upper portion 118B than when in the use position.

Figure 10:
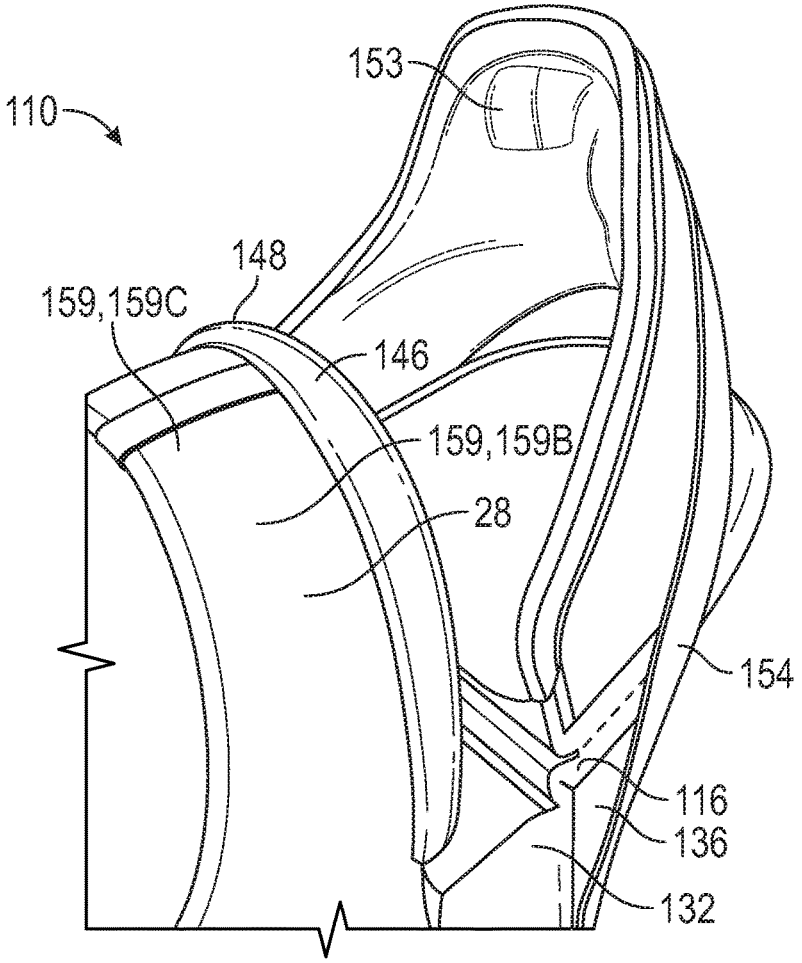
FIG. 10 is a schematic illustration in fragmentary perspective view of the article of footwear of FIG. 4 in the access position.

The front upper portion 118A has a rear portion 159 that extends upward and around the rear periphery 148 of the heel footbed 146 from the lateral side 26 (see FIG. 8) to the medial side 28 (see FIG. 10). The rear portion 159 has a lateral wall 159A, a medial wall 159B, and a rear wall 159C connecting the lateral wall 159A and the medial wall 159B so that the walls 159A, 159B, 159C form a continuous inner heel cup. The rear portion 159 is disposed laterally inward of the medial and lateral sides of the rear upper portion 118B when the article of footwear 110 is in the use position. More specifically, as shown in FIG. 4, a lateral wall 117A of the rear upper portion 118B is laterally outward of and adjacent to the lateral wall 159A of the rear portion 159 of the front upper portion 118A in the use position. A medial wall 117B of the rear upper portion 118B is laterally outward of and adjacent to the medial wall 159B of the rear portion 159 of the front upper portion 118A in the use position. As used herein, a component is laterally outward of another component if it is further from a longitudinal axis of the footwear in a transverse direction of the footwear (i.e., along the width of the footwear). The footwear upper 118 thus has a double wall thickness at the heel portion 24 due to the overlapping front upper portion 118A and rear upper portion 118B. The double wall thickness lends lateral stability to the heel region 24 of the upper 118 in the use position.

Figure 8:
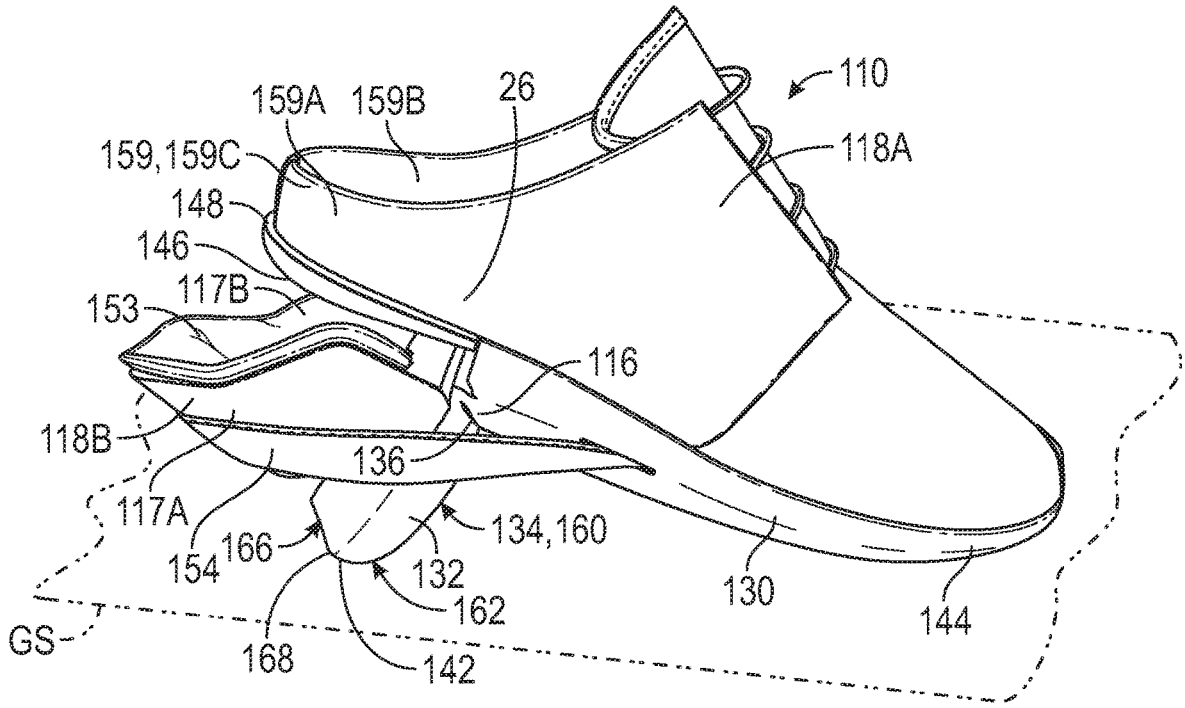
FIG. 8 is a schematic illustration in perspective view of the lateral side of the article of footwear of FIG. 4 in an access position.
Figure 9:
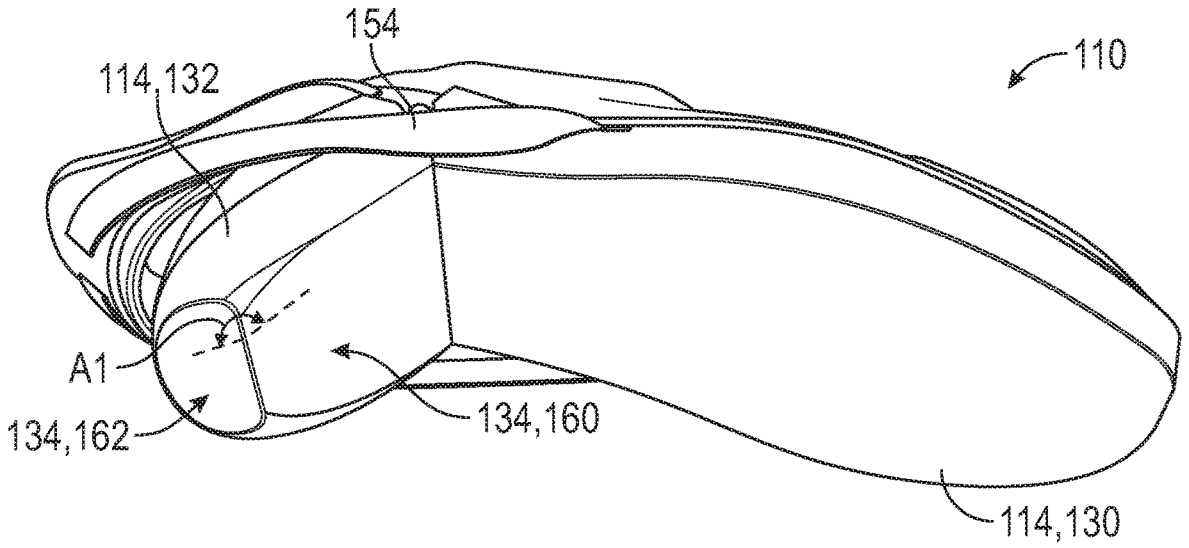
FIG. 9 is a schematic illustration in perspective view of a bottom of the midsole of the article of footwear of FIG. 4 in the access position.

The rear upper portion 118B includes a compliant protrusion 153 best shown in FIGS. 4, 8 and 10 that protrudes forward into the foot-receiving cavity 145 above the heel footbed 146 when the front midsole portion 130 and the rear midsole portion 132 are in the use position. The protrusion 153 may be, for example, foam padding at the inner periphery of the rear upper portion 118B. The protrusion 153 can be configured to be disposed above the heel footbed 146 in the use position to help trap the heel footbed 146 below the protrusion 153, but also provides enough compliance both to permit the footbed 146 to move past the protrusion 153 when moving to the access position, and so that the rear upper portion 118B comfortably secures to ankles of different girths.

The front upper portion 118A and the rear upper portion 118B define the ankle opening 143 that leads into the foot-receiving cavity 145 in which a wearer's foot is supported and secured during use of the footwear 110. In the use position, the size of the ankle opening 143 is determined by the walls 159A, 159B, 117A, 117B of the overlapping upper portions 118A, 118B. The footwear 110 has a tongue 121 and a lacing system 123. The lacing system 123 may be adjusted to vary the size of the ankle opening 143 in the use position. However, due to the ability of the footwear 110 to be selectively pivoted to the access position, and to remain in the access position until use is desired, the lacing system 123 may be initially adjusted to a desired tightness to obtain a desired fit in the use position, and then left at the initial tightness setting during subsequent removals of the footwear 110 from the foot and placement of the footwear 110 on the foot.

In the access position, the front upper portion 118A and the rear upper portion 118B do not overlap, and the walls 159A, 159B are separated from (i.e., not adjacent to) the walls 117A, 117B, widening the ankle opening substantially. In fact, due to the incline of the front upper portion 118A presented in the access position, a foot can slide forward into the foot-receiving cavity 145 at the front upper portion 118A with the toes entering at a downward and forward trajectory using the heel footbed 146 as a guide, and without a need to stretch, open, shift, or otherwise displace any portion of the footwear 110, because the rear upper portion 118B is disposed entirely below the entry angle for the front upper portion 118A. When the foot is inserted into the front upper portion 118A and weight is placed on the front midsole portion 130, the front midsole portion 130 is urged to return to the use position, causing the living hinge 116 to pivot back to the use position, and the rear upper portion 118B to surround a rear portion of the foot, capturing the foot within the foot-receiving cavity 145.

An elastic biasing member 154 is secured at the medial side 28 of the front midsole portion 130 and at the lateral side 26 of the front midsole portion 130 and extends around a rear periphery 156 of the rear upper portion 118B. The elastic biasing member 154 can be any resiliently stretchable material, such as rubber or elastic nylon. The elastic biasing member 154 may loop around the rear periphery 156 of the rear upper portion 118B and is secured to both the medial side 28 and the lateral side 26 of the front midsole portion 130, or the elastic biasing member 154 may have a medial side component and a separate lateral side component. The elastic biasing member 154 may have ends that secure to the front midsole portion 130 in recesses 155 at the opposite sides, or the recesses 155 may be openings of a transverse channel in the front midsole portion 130 that opens at the lateral side 26 and the medial side 28, and the elastic biasing member 154 may be a continuous loop that extends through the channel. In still other embodiments, the elastic biasing member 154 can be secured to article of footwear 110 between the front midsole portion 130 and the front upper portion 118A. For example, the elastic biasing member 154 can be stitched to the front upper portion 118A at a lower region of the front upper portion 118A that is then secured to the upper surface 138 of the front midsole portion 130. As another alternative, the elastic biasing member 154 could pass under the bottom surface 134 of the front midsole portion 130 (and under any outsole or outsole elements that may be secured thereto). In each alternative, the elastic biasing member 154 secures to the footwear 110 forward of the living hinge 116 at an anchor location that causes a portion of the elastic biasing member 154 that is in tension to cross over or close to the living hinge 116 so that the living hinge 116 is a bi-stable living hinge (i.e., stable in both the use position and the access position). The elastic biasing member 154 is of a length such that it is in tension when in the use position in order to keep the upper portions 118A, 118B contiguous during wear, and is also in tension when the footwear 10 is in the access position of FIG. 8, in order to maintain the footwear 110 in the access position, ready for foot entry.

The article of footwear 110 is configured to stably balance on a horizontal surface and remain in the access position awaiting foot entry. More specifically, with reference to FIG. 9, the bottom surface 134 of the unitary midsole 114 in the heel region 24 has a main portion 160 and a rearmost portion 162 extending from and disposed at an obtuse angle A1 to the main portion 160 so that the main portion 160 of the bottom surface 134 extends along a horizontal plane in the first orientation (i.e., the use position, see FIG. 4), and the rearmost portion 162 of the bottom surface 134 extends along the horizontal plane in the second orientation (i.e., the access position, see FIG. 8). The horizontal plane GS is indicated in phantom in FIGS. 4 and 8 and represents a horizontal ground surface. Accordingly, the article of footwear 110 rests on the main portion 160 in the use position, and rests on the rearmost portion 162 in the access position. The angle A1 may be the same as the angle between the walls of the groove 136 when the groove 136 is in the use position so that the rearmost portion 162 is level when the groove closes (i.e., such as in the access position)

The article of footwear 110 is also configured to facilitate hands-free removal. The top surface 138 of the second portion 132 of the unitary midsole 114 has a main portion 164 (see FIGS. 5 and 7) and a rearmost portion 166 extending from and disposed at an obtuse angle A2 to the main portion 164 so that the second portion 132 has a ridge 168 between the rearmost portion 162 of the bottom surface 134 and the rearmost portion 166 of the top surface 138. The rearmost portion 166 extending to the ridge 168 protrudes sufficiently to allow an opposite foot to place a downward load thereon, causing the midsole 114 to pivot at the living hinge 116 to move the footwear 110 to the access position. The access position also serves as a removal position that enables hands-free withdrawal of the foot from the foot-receiving cavity 145.

FIGS. 11-14 depict another embodiment of an article of footwear 210 within the scope of the present teachings. The article of footwear 210 has many of the same features as the articles of footwear 10 and 110, some of which features are indicated with like reference numbers. The description of the corresponding features of the articles of footwear 10 and 110 applies equally to the article of footwear 210. For example, the article of footwear 210 includes the midsole 114 with the living hinge 116, with the bottom surface 134 with the rearmost portion 162 that provides stability for the footwear 210 resting in the access position, and the top surface 138 with the rearmost portion 166 that enable the footwear 210 to be removed in a hands-free manner.

The article of footwear 210 includes a divided footwear upper 218 with a front upper portion 218A and a rear upper portion 218B. The front upper portion 218A functions the same as and has the same features as front upper portion 118A, except that it is a laceless style. The rear upper portion 218B functions the same as and has the same features as the rear upper portion 118B except that walls 117A, 117B and the elastic biasing member 154 are replaced with walls 217A, 217B that establish the rear periphery 256 of the rear upper portion 118B and are secured to the lateral and medial sides 26, 28 of the front midsole portion 130. Similarly as discussed with respect to elastic midsole portion 154, the walls 217A, 217B can be secured to the footwear 210 anywhere forward of the living hinge 116 such that portions in tension cross over or close to the living hinge 116 along the lateral and medial sides of the article of footwear 210. For example, the walls 217A, 217B can be stitched to the front upper portion 218A at a lower region of the front upper portion 218A that is then secured to the upper surface 138 of the front midsole portion 130. As another alternative, the walls 217A, 217B could pass under the bottom surface 134 of the front midsole portion 130 (and under any outsole or outsole elements that may be secured thereto). The walls 217A, 217B can be part of a continuous loop that passes through a channel in the front midsole portion 130 that opens at the medial and lateral sides. The walls 217A, 217B are of an elastic material, such as a stretchable nylon so that the walls 217A, 217B also serve as the elastic biasing member. The rear upper portion 218B thus includes the elastic biasing member.

Figure 11:
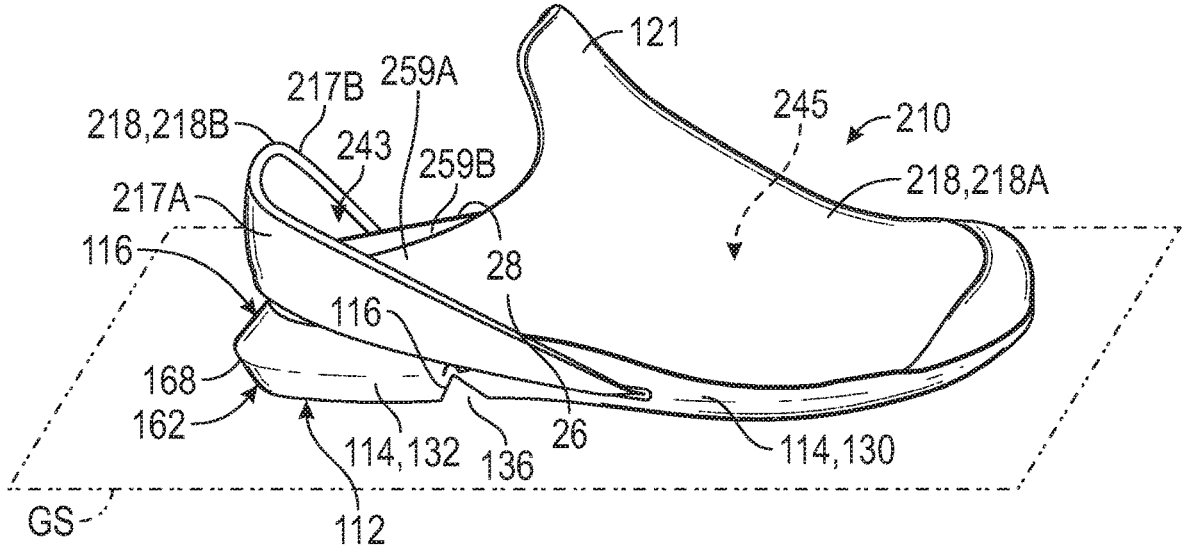
FIG. 11 is a schematic illustration in perspective view of a lateral side of another embodiment of an article of footwear in a use position.
Figure 12:
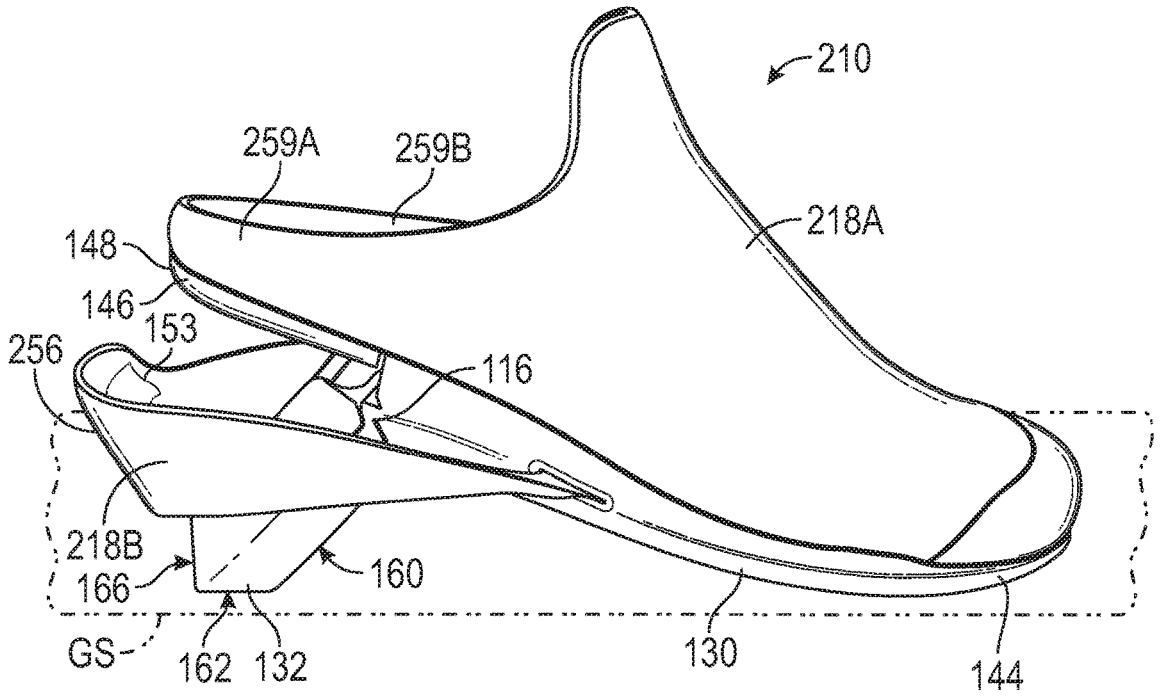
FIG. 12 is a schematic illustration in perspective view of the lateral side of the article of footwear of FIG. 11 in an access position.
Figure 13:
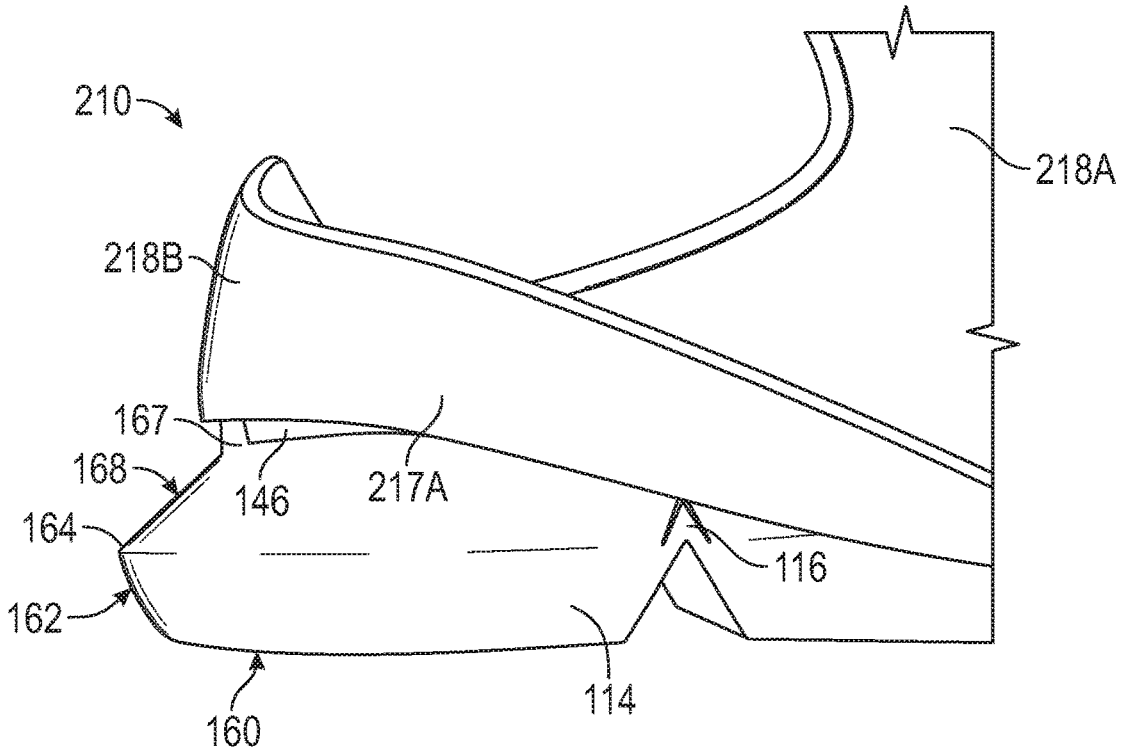
FIG. 13 is a schematic illustration in fragmentary side view of the lateral side of the article of footwear of FIG. 11 in the use position.
Figure 14:
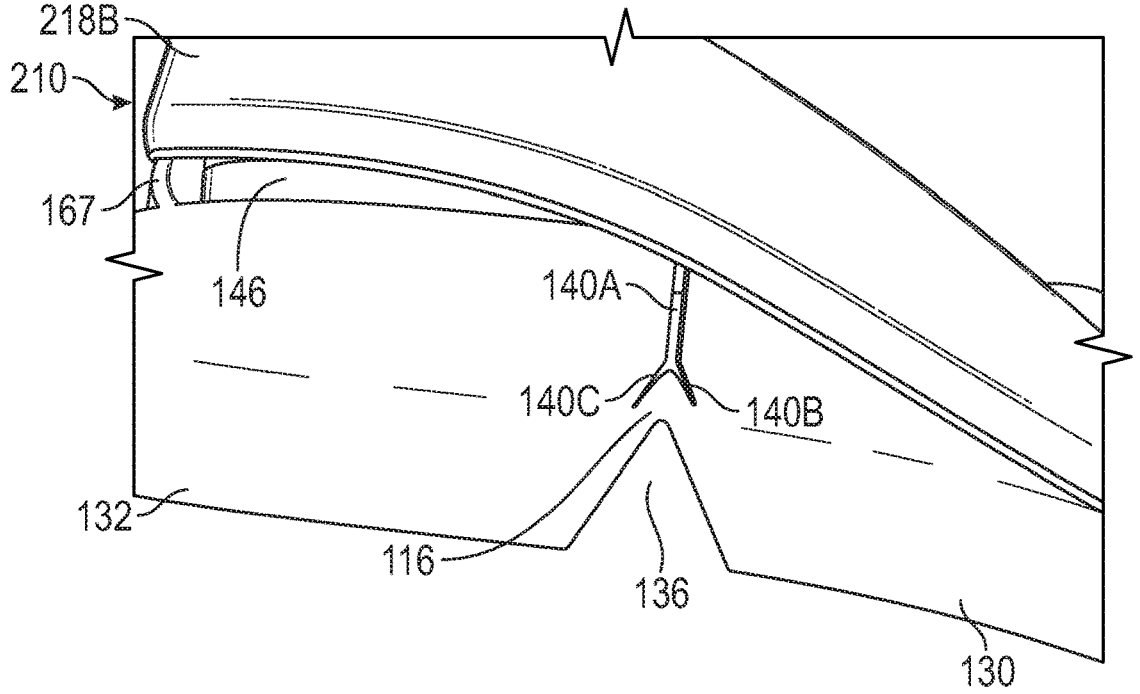
FIG. 14 is a schematic illustration in fragmentary side view of the lateral side of the article of footwear of FIG. 11 in the use position.

The rear upper portion 218B overlaps the front upper portion 218A in the use position of FIG. 11 as the walls 217A, 217B are disposed laterally outward of lateral side wall 259A and a medial side wall 259B, respectively, of the front upper portion 218A when the article of footwear 210 is in the use position. A rear periphery 148 of the heel footbed 146 is surrounded by the rear upper portion 218B and overlays the rear midsole portion 132 in the use position shown in FIG. 11. As best shown in FIGS. 13-14, the rear midsole portion 132 has a rear lip 167 that extends upward and rearward of the heel footbed 146 and supports the rear upper portion 218B. The heel footbed 146 is within the foot-receiving cavity 245 formed by the upper portions 218A, 218B in the use position. In the access position of FIG. 12, the heel footbed 146 is exposed above the rear midsole portion 132, and is disposed further away from the rear upper portion 218B than when in the use position. An ankle opening in the access position is thus larger than the ankle opening 243 formed by the upper portions 218A, 218B in the use position.

Figure 15:
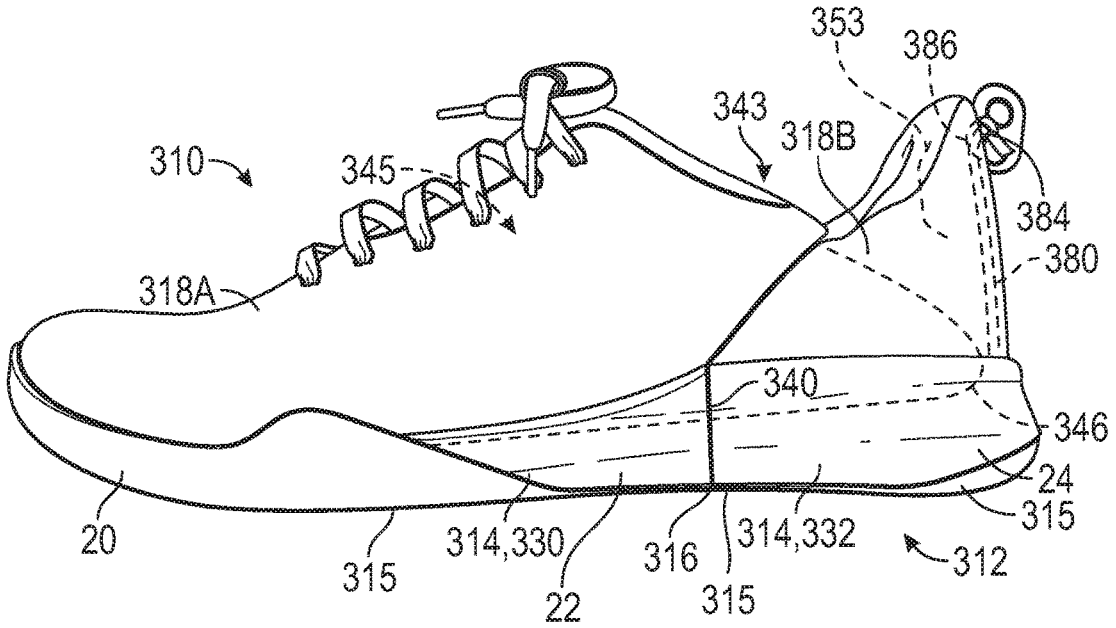
FIG. 15 is a schematic illustration in perspective view of a medial side of another embodiment of an article of footwear in a use position.
Figure 16:
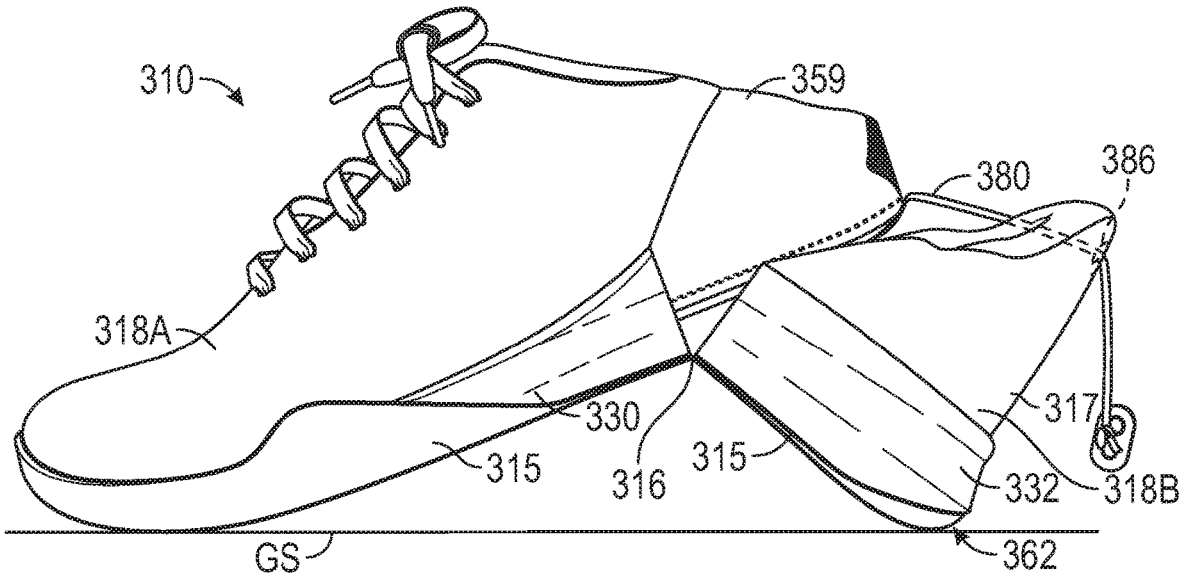
FIG. 16 is a schematic illustration in perspective view of the medial side of the article of footwear of FIG. 15 in an intermediate position.
Figure 17:
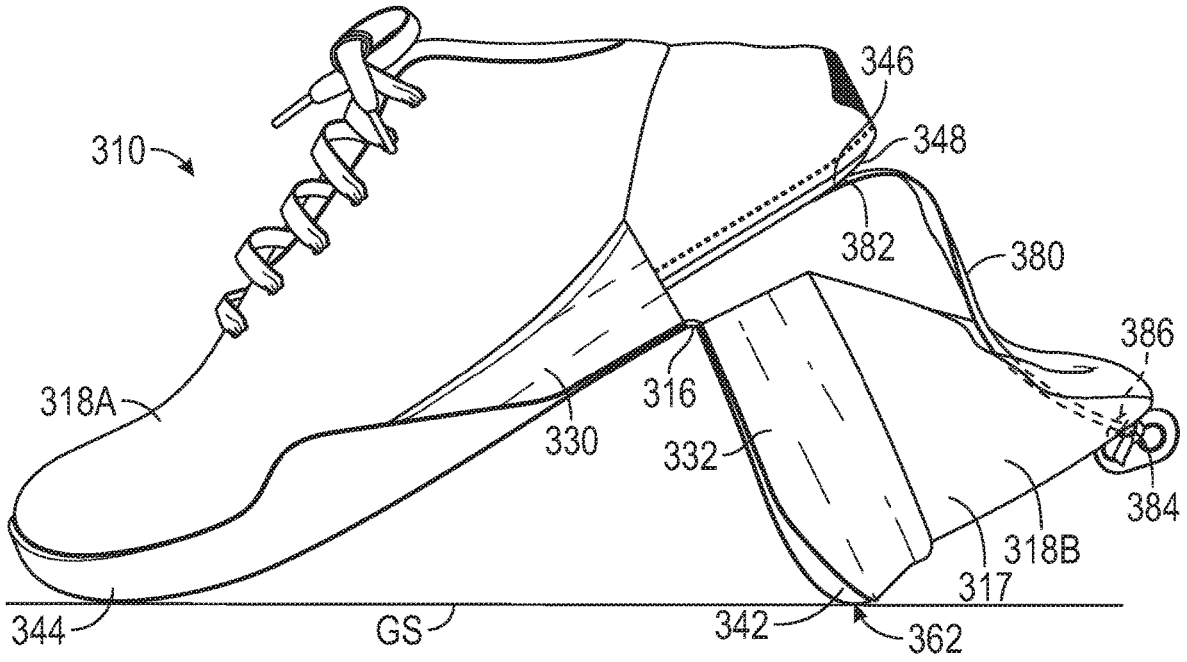
FIG. 17 is a schematic illustration in perspective view of the medial side of the article of footwear of FIG. 15 in an access position.
Figure 18:
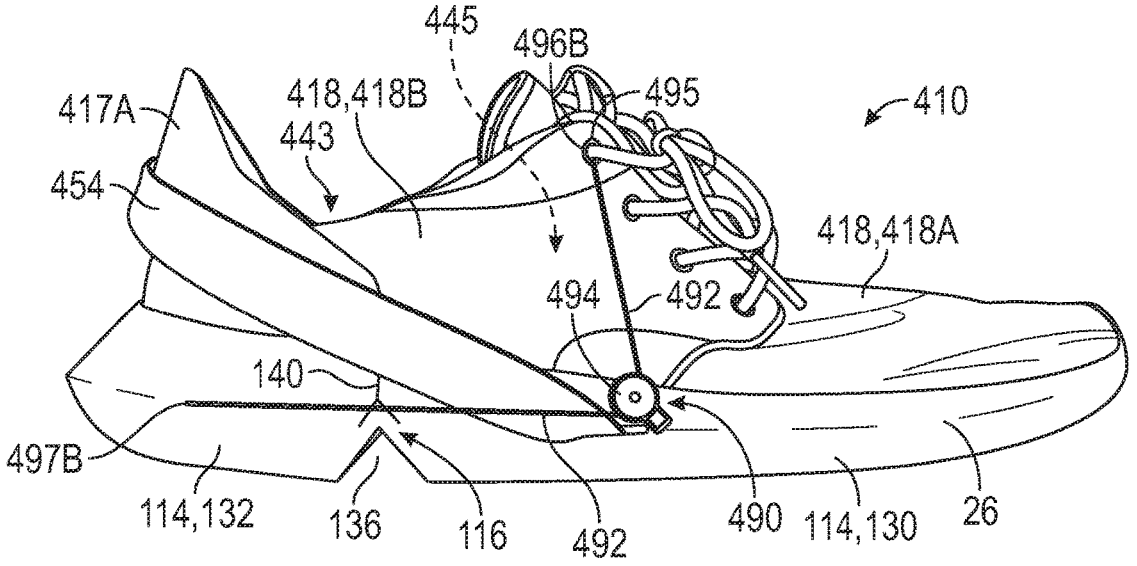
FIG. 18 is a schematic illustration in side view of a lateral side of another embodiment of an article of footwear in a use position.

FIGS. 15-17 show another embodiment of an article of footwear 310 within the scope of the present teachings. The article of footwear 310 has many of the same features as the articles of footwear 10, 110, and 210, some of which are indicated with like reference numbers. The description of the corresponding features of the articles of footwear 10, 110, 210 applies equally to the article of footwear 310. For example, the article of footwear 310 includes a sole structure 312 with a living hinge 316. The sole structure 312 includes a midsole 314 and an outsole 315 secured to a bottom surface of the midsole 314. The outsole 315 is a full-length outsole with a forefoot region 20, a midfoot region 22, and a heel region 24. The midsole 314 has a slit 340 that extends to the outsole 315. The slit 340 divides the midsole 314 into a front midsole portion 330, also referred to as a front sole portion, and a rear midsole portion 332, also referred to as a rear sole portion. The front midsole portion 330 and the rear midsole portion 332 can be formed as one-piece with a slit molded in or cut after molding, or the midsole portions 330, 332 can be separately molded. In the use position, the front midsole portion 330, the rear midsole portion 332, and the living hinge 316 are substantially coplanar in a plane parallel to the horizontal ground surface GS. The outsole 315 has a bottom surface with a rearmost portion 362 on which the footwear 310 rests and that provides stability for the footwear 310 resting in the access position of FIG. 17. In the access position of FIG. 17, the sole structure 312 is lifted at the living hinge 316 relative to the use position of FIG. 15 so that the rear sole portion 332 inclines from a rear end 342 to the living hinge 316, and the front sole portion 330 inclines from a forward end 344 to the living hinge 316, as shown in FIG. 17. FIG. 16 is a position between the use position of FIG. 15 and the access position of FIG. 17. In the access position, the slit 340 opens, and the outsole 315 functions as a living hinge 316 below the open slit 340.

The article of footwear 310 includes a divided footwear upper 318A, 318B with a front upper portion 318A and a rear upper portion 318B. The front upper portion 318A functions the same as and has the same features as front upper portion 118A. The rear upper portion 318B functions the same as and has the same features as the rear upper portion 118B. In the use position, the front and rear upper portions 318A, 318B overlap at the heel region 24. More specifically, side walls 359 (one shown in FIG. 16) of the rear portion of the front upper portion 318A overlap with side walls 317 (one shown) of the rear upper portion 318B.

The front upper portion 318A overlaps the rear upper portion 318B in the use position of FIG. 15 as the side walls 317 (one visible in the side view shown) are disposed laterally outward of side walls 359 of a rear portion of the front upper portion 318A when the article of footwear 310 is in the use position. A rear periphery 348 of the heel footbed 346 extending rearward from the front upper portion 318A is surrounded by the rear upper portion 318B and overlays the rear midsole portion 332 in the use position shown in FIG. 15. In the access position of FIG. 17, the heel footbed 346 is exposed above the rear midsole portion 332, and disposed further away from the rear upper portion 318B than when in the use position. The rear upper portion 318B may have a protrusion 353 (see FIG. 15) that extends into the foot-receiving cavity 345 and is disposed above the heel footbed 346 in the access position, similar to protrusion 153. An ankle opening 343 in the access position is thus larger than the ankle opening formed by the upper portions 318A, 318B in the use position. Access to the foot-receiving cavity 345 is thus easier in the access position, as discussed with respect to footwear 110.

There is no elastic biasing member secured to the front midsole portion 330 in the article of footwear 310. Instead, the footwear 310 includes a strap 380. The strap 380 has a fixed end 382 secured to the heel footbed 346 and a free end 384 extending through an aperture 386 in the rear upper portion 318B. The strap 380 has a length configured so that the strap 380 is slack when the midsole 314 is in the access position of FIG. 17, and the front upper portion 318A pivots toward the use position when the strap 380 is pulled taut by the free end 384. The strap 380 may be pulled taut by the weight of a foot entering the front upper portion 318A in the access position, returning the footwear 310 to the use position. The strap 380 may also be manually pulled to return the footwear 310 to the use position. The strap 380 also prevents over-extension of the living hinge 316 by limiting the maximum pivot of the midsole portions 330, 332 relative to one another to an orientation in which the strap 380 becomes taut.

FIGS. 18-22 show another embodiment of an article of footwear 410. The article of footwear 410 includes the unitary midsole 114 with all of the features and functions as described with respect to FIGS. 4-10, including the groove 136 and the slit 140 at which the midsole 114 forms the living hinge 116, or any of the alternative living hinge configurations described herein. The article of footwear 410 also includes a divided upper 418 with a front upper portion 418A and a rear upper portion 418B. The front upper portion 418A includes a rear portion 459 with lateral and medial walls 459A, 459B, respectively (see FIG. 21), and the rear upper portion 418B has lateral and medial walls 417A, 417B that overlap with the walls 459A, 459B when the heel footbed 446 extending rearward from the front upper portion 418A overlies the rear midsole portion 132 and the footwear 410 is in the use position of FIGS. 18-20, similarly as described with respect to walls 117A, 117B, 159A, 159B of FIG. 4. An elastic biasing member 454 that functions identically as biasing member 154 is secured to the medial and lateral sides of the front midsole portion 130 of the unitary midsole 114 in the same manner as biasing member 154, and may extend transversely through the midsole 114 as described with respect to biasing member 154 or may have any of the other configurations described with respect to biasing member 154.

The front upper portion 418A and the rear upper portion 418B define the ankle opening 443 (see FIG. 18), that leads into the foot-receiving cavity 445 in which a wearer's foot is supported and secured during use of the footwear 410. In the use position, the size of the ankle opening 443 is determined by the walls 459A, 459B, 417A, 417B of the overlapping upper portions 418A, 418B. In the access position, the upper portions 418A, 418B are separated, with the rear upper portion 418B below the heel footbed 446, and the ankle opening 443 is widened relative to the size of the ankle opening 443 in the use position.

The article of footwear 410 includes a cinching system 490 for tightening the footwear upper 418 in the use position. The cinching system 490 is shown and described with respect to the article of footwear 410, but could also be used on any of the articles of footwear within the scope of the present teachings, such as articles of footwear 10, 110, 210, and 310. The cinching system 490 includes at least one cable 492 extending at least partially over the front upper portion 418A and secured to the rear midsole portion 132 at one of the lateral side 26 or the medial side 28 of the unitary midsole 114. The at least one cable 492 may be a cord, a wire, a string, a strand, a lace, or another elongated tensile element.

The pulley 494 is secured to the front midsole portion 130 at the same side at which the cable 492 is secured. In the embodiment shown, there are two pulleys 494, one on each of the lateral side and the medial side 26, 28. A single cable 492 passes through eyelets 495 and over the top of the front upper portion 418A between the two sides 26, 28. In an alternative embodiment, there are two cables 492, one secured to each side and each anchored at a respective eyelet or elsewhere.

Figure 19:
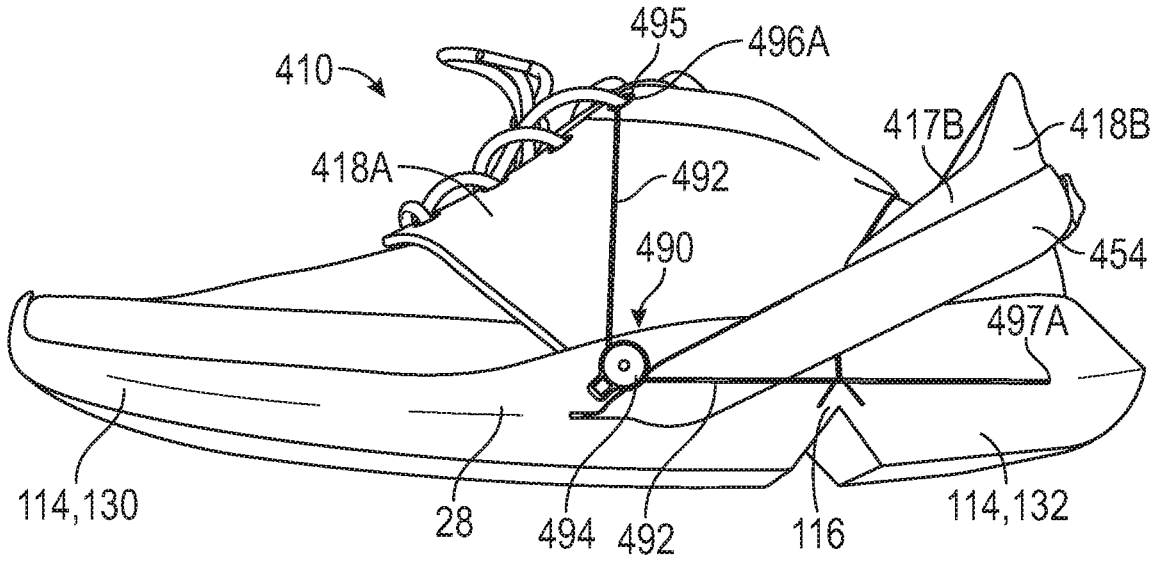
FIG. 19 is a schematic illustration in perspective view of a medial side of the article of footwear of FIG. 18.
Figure 20:
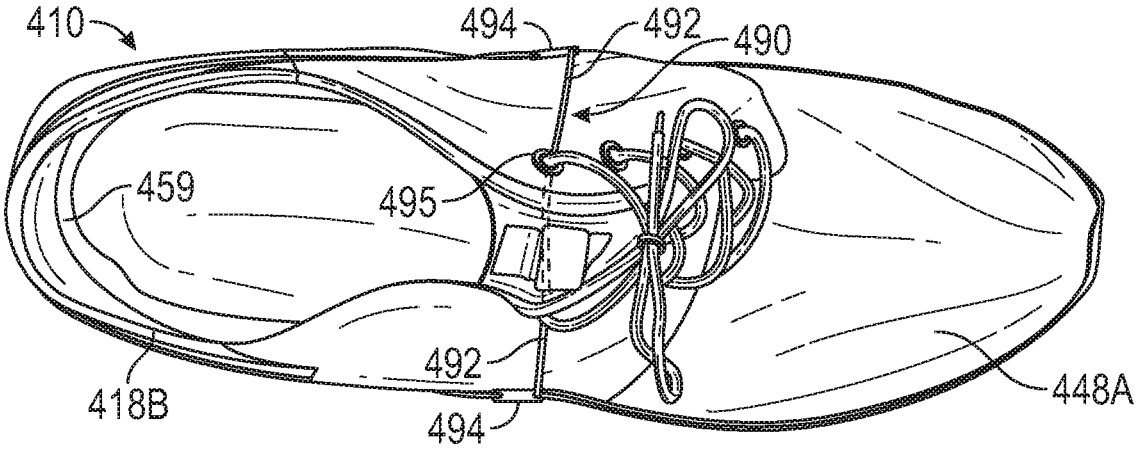
FIG. 20 is a schematic illustration in plan view of the article of footwear of FIG. 18.
Figure 21:
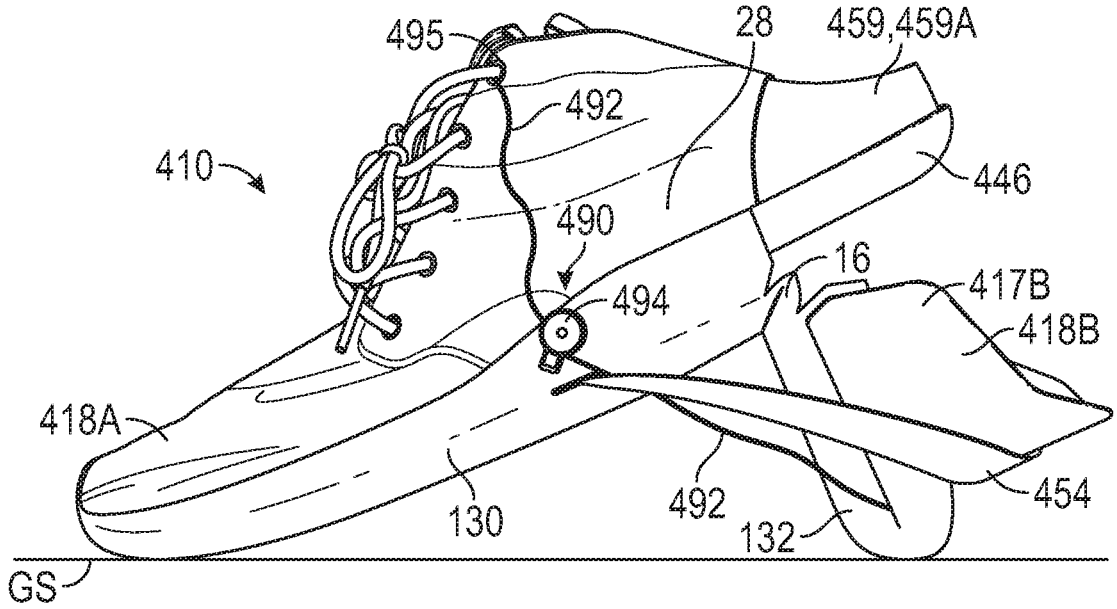
FIG. 21 is a schematic illustration in side view of the medial side of the article of footwear of FIG. 18 in an access position.
Figure 22:
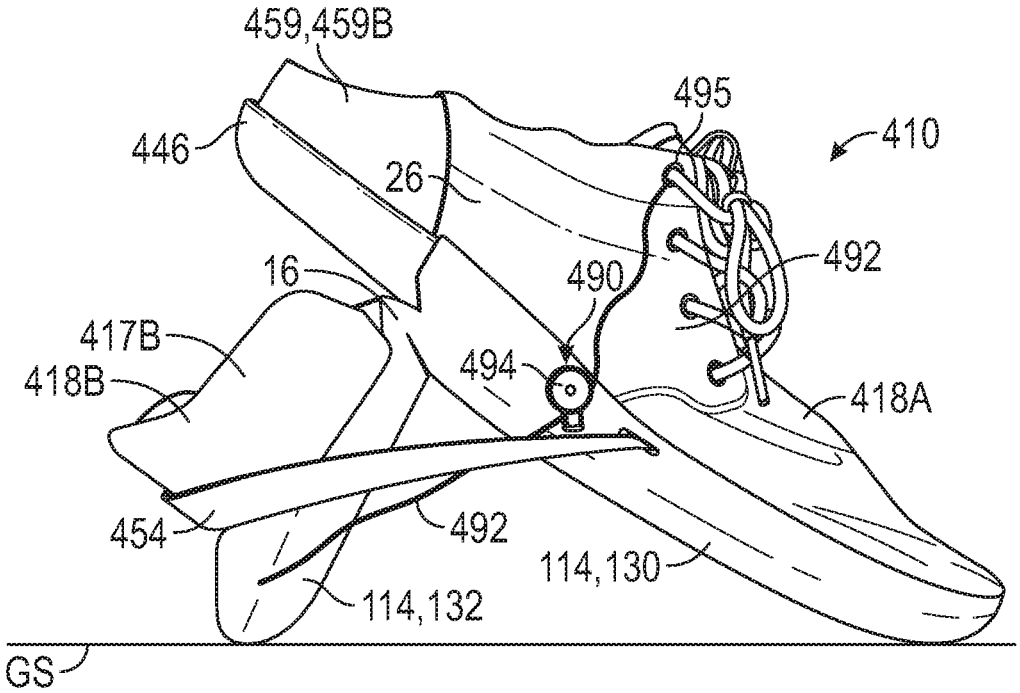
FIG. 22 is a schematic illustration in side view of the lateral side of the article of footwear of FIG. 18 in the access position.

As shown in FIG. 19, the cable 492 extends along the medial side 28 and has a portion 496A that passes through eyelet 495. The cable 492 also has an end 497A secured to the medial side 28 of the rear midsole portion 132. The cable 492 extends along the lateral side 26 and has a portion 496B that passes through an eyelet 495. The cable 492 also has an end 497B secured to the lateral side 26 of the rear midsole portion 132. The cable 492 extends around the first pulley 494 between the portion 496A of the first cable 492 and the second end 497A of the first cable 492. The second pulley 494 is secured to the lateral side 26 of the front midsole portion 418A. The cable 492 extends around the second pulley 494 between the portion 496B of the cable 492 and the end 497B of the cable 492. Due to the positioning of the first end, the pulley, and the second end on each of the sides, the cable 492 is relatively slack when the front midsole portion 130 and the rear midsole portion 132 are in the access position, and is relatively taut when the front midsole portion 130 and the rear midsole portion 132 are in the use position. Accordingly, when the footwear 410 returns to the use position from the access position (such as when the weight of a foot enters the foot-receiving cavity 445 in the front upper portion 418A), the footwear 410 returns to the use position, and the cinching system 490 is automatically tightened, pulling the front upper portion 418A snugly against the foot.

A method of manufacturing footwear such as the footwear 10, 110, 210, 310, and/or 410 disclosed herein comprises forming a midsole having a front midsole portion, a rear midsole portion, and a living hinge extending transversely across the midsole from a medial side 28 of the midsole to a lateral side 26 of the midsole and connecting the front midsole portion and the rear midsole portion. For example, with respect to unitary midsole 114, forming the unitary midsole 114 may include molding the unitary midsole 114 such as by one of compression molding or injection molding. Molding the unitary midsole 114 may include molding a bottom surface 34 of the unitary midsole 114 with a groove 136 extending from a medial side 28 of the unitary midsole to a lateral side 26 of the unitary midsole 114. Molding the bottom surface 34 of the unitary midsole 114 may also include molding the bottom surface of the rear midsole portion 132 with a main portion 160 and a rearmost portion 162 extending from and disposed at an obtuse angle A1 to the main portion 160.

Molding the unitary midsole 114 may include molding a top surface 138 of the unitary midsole 114 with a slit 140, or with any of the other configurations of slits 40, 540, 640, 740 disclosed herein. The method may include molding both the groove 136 and the slit 140 (or slit 40, 540, 640, 740) in the same mold contemporaneously, without any secondary processing steps needed to provide the groove 136 and the slit 140. For example, if the mold is configured with a mold cavity corresponding to an intermediate position of the midsole 114 in which the groove 136 is partly closed and the slit 140 is partly open, both can be molded contemporaneously.

Alternatively, instead of molding the groove 136 and/or the slit 140, the method of manufacturing footwear such as footwear 110 may instead include providing the groove 136 in the bottom surface 34 of the unitary midsole 114 by hot knife cutting or laser cutting, either of which would occur after molding the unitary midsole 114. The groove 136 extends from the medial side 28 of the unitary midsole 114 to the lateral side 26 of the unitary midsole 114. The method may further comprise providing a slit 140 in a top surface 38 of the unitary midsole 114 by hot knife cutting or laser cutting. The slit 140 as provided extends from the medial side 28 of the unitary midsole to the lateral side 26 of the unitary midsole and is disposed over the groove 136.

Still further, the method may include attaching an outsole to bottom surfaces of segmented front and rear midsole portions, with the outsole at least partially forming the living hinge. For example, in one embodiment, the front and rear midsole portions are segmented (i.e., not physically connected to one another), either because they are molded or otherwise formed separately, or because a formed midsole is cut or otherwise separated into portions. The outsole is secured to bottom surfaces of the segmented front and rear midsole portions. The separation between the front and rear midsole portions thereby forms a slit, while the outsole connects the front and rear midsole portions and flexes under the slit as a living hinge, as shown and described with respect to midsole portions 330, 332 and outsole 315 of FIGS. 15-17.

In yet another embodiment, the midsole 114 can be provided with the groove, such as groove 136 by molding, and an outsole such as outsole 315 can be secured to a bottom surface 134 of the midsole 114, including the portion of the bottom surface 134 in the groove 136. In such an embodiment, the outsole lines the groove and portions of the outsole secured in the groove close together against one another when the groove closes.

After the midsole is formed, the method includes securing a front upper portion such as front upper portion 118A to the front midsole portion, such as front midsole portion 130, and securing a rear upper portion such as rear upper portion 118B to the rear midsole portion such as rear midsole portion 132, with the rear upper portion divided from the front upper portion, such as described with respect to each of the embodiments of footwear 10, 110, 210, 310, 410. The upper portions, such as upper portions 118A, 118B may be secured to the respective midsole portions, such as midsole portions 130, 132, by thermal bonding, radio frequency welding, adhesive, stitching, or otherwise.

After the upper portions are secured to the midsole portions, the method includes securing an elastic biasing member 54 or 154 to the footwear 10 or 110 forward of the living hinge 16 or 116, such as at the front midsole portion 30 or 130 at the medial side 28 of the unitary midsole 14 or 114 and at the lateral side 26 of the unitary midsole 14 or 114 so that the elastic biasing member 154 extends around a rear periphery 56 or 156 of the rear upper portion 18B or 118B and along medial and lateral sides of the article of footwear 10 or 110. Alternatively, the rear upper portion itself may serve as an elastic biasing member, and may secure forward of the living hinge, such as rear upper portion 218B secures forward of living hinge 116 in FIG. 12. Alternatively or in addition to securing an elastic biasing member as described, the method may include attaching a strap 380 to a heel footbed 346 of the front upper portion 318A as described with respect to the article of footwear 310. The method may also include extending a free end 384 of the strap 380 through an aperture 386 in the rear upper portion 318B.

With respect to the article of footwear 410, the method further comprises securing a pulley 494 to the front midsole portion 130 at one of the medial side 28 or the lateral side 26, and securing at least one cable 492 to the rear midsole portion 132 at the same one of the medial side 28 or the lateral side 26 of the unitary midsole 114 so that the cable extends around the pulley at and at least partially over the front upper portion. The at least one cable may be a cable, a lace, or another elongated tensile element.

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above", "below", "upward", "downward", "top", "bottom", etc., may be used descriptively relative to the figures, without representing limitations on the scope of the invention, as defined by the claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear comprising:

a unitary midsole having a first portion and a second portion rearward of the first portion;

wherein a bottom surface of the unitary midsole defines a groove extending from a medial side of the unitary midsole to a lateral side of the unitary midsole, and a top surface of the unitary midsole defines a slit disposed over the groove and extending from the medial side to the lateral side;

wherein the unitary midsole forms a living hinge at the groove and the slit, with the living hinge connecting the first portion to the second portion so that the first portion and the second portion are selectively pivotable relative to one another at the living hinge between a first orientation and a second orientation; wherein the groove is wider in the first orientation than in the second orientation, and the slit is wider in the second orientation than in the first orientation;

wherein the slit includes:

a main portion extending downward from the top surface of the unitary midsole toward the groove and having a distal end spaced above the groove;

a front branch extending from the distal end of the main portion into the first portion and terminating above the bottom surface; and a rear branch extending from the distal end of the main portion into the second portion and terminating above the bottom surface.

2. The sole structure of claim 1, wherein the slit is closed and the groove is open in the first orientation, and the slit is open and the groove is closed in the second orientation.

3. The sole structure of claim 1, wherein:

the unitary midsole has a front wall and a rear wall in the bottom surface at the groove;

the front branch of the slit extends above the front wall; and the rear branch of the slit extends above the rear wall.

4. The sole structure of claim 1, wherein:

the first portion of the unitary midsole includes a forefoot region and a midfoot region;

the second portion of the unitary midsole includes a heel region; and the bottom surface of the unitary midsole in the heel region has a main portion and a rearmost portion extending from and disposed at an obtuse angle to the main portion so that the main portion of the bottom surface extends along a horizontal plane in the first orientation, and the rearmost portion of the bottom surface extends along the horizontal plane in the second orientation.

5. The sole structure of claim 4, wherein the top surface of the unitary midsole in the second portion has a main portion and a rearmost portion extending from and disposed at an obtuse angle to the main portion so that the second portion has a ridge between the rearmost portion of the bottom surface and the rearmost portion of the top surface.

6. An article of footwear comprising:

a sole structure including a unitary midsole having a front sole portion, a rear sole portion rearward of the front sole portion, and a living hinge extending transversely across the sole structure from a medial side to a lateral side of the sole structure and connecting the front sole portion to the rear sole portion;

a divided footwear upper including a front upper portion and a separate rear upper portion; wherein the front upper portion is fixed to the front sole portion and defines at least a forefoot region of the divided footwear upper, and the rear upper portion is fixed to the rear sole portion and defines a heel region of the divided footwear upper;

an elastic biasing member that extends around a rear periphery of the rear upper portion and along a medial side of the article of footwear and a lateral side of the article of footwear;

wherein the elastic biasing member is secured to the article of footwear forward of the living hinge;

wherein the front sole portion and the rear sole portion are selectively pivotable relative to one another at the living hinge between a use position and an access position;

wherein, in the use position, the front upper portion and the rear upper portion together define a foot-receiving cavity and an ankle opening, and the rear upper portion overlaps the front upper portion at the medial side of the sole structure and at the lateral side of the sole structure; and wherein, in the access position, the front upper portion and the rear upper portion are spaced apart from one another so that the ankle opening is larger than in the use position;

wherein a bottom surface of the unitary midsole defines a groove extending from the medial side of the sole structure to the lateral side of the sole structure, and a top surface of the unitary midsole defines a slit disposed over the groove and extending from the medial side of the sole structure to the lateral side of the sole structure;

wherein the unitary midsole forms the living hinge at the groove and the slit, with the groove wider in the use position than in the access position, and with the slit wider in the access position than in the use position; and wherein the slit includes:

a main portion extending downward from the top surface of the unitary midsole toward the groove and having a distal end spaced above the groove;

a front branch extending from the distal end of the main portion into the front sole portion and terminating above the bottom surface; and a rear branch extending from the distal end of the main portion into the rear sole portion and terminating above the bottom surface.

7. The article of footwear of claim 6, wherein:

the front upper portion includes a heel footbed;

a rear periphery of the heel footbed is surrounded by the rear upper portion and overlays the rear sole portion in the use position; and the heel footbed is disposed further away from the rear upper portion when the front sole portion and the rear sole portion are in the access position than when in the use position.

8. The article of footwear of claim 6, wherein:

the front sole portion includes a heel footbed;

a rear periphery of the heel footbed is surrounded by the rear upper portion and overlays the rear sole portion in the use position; and the heel footbed is disposed further away from the rear upper portion when the front sole portion and the rear sole portion are in the access position than when in the use position.

9. The article of footwear of claim 6, wherein the front sole portion includes a heel footbed and the rear upper portion includes a compliant protrusion that protrudes forward into the foot-receiving cavity above the heel footbed when the front sole portion and the rear sole portion are in the use position.

10. The article of footwear of claim 6, wherein:

the front sole portion, the rear sole portion, and the living hinge are coplanar in the use position; and the sole structure is lifted at the living hinge in the access position relative to the use position so that the rear sole portion inclines from a rear end of the rear sole portion to the living hinge, and the front sole portion inclines from a forward end of the front sole portion to the living hinge.

11. An article of footwear comprising:

a unitary midsole having a front midsole portion, a rear midsole portion rearward of the front midsole portion, and a living hinge extending transversely across the unitary midsole from a medial side of the unitary midsole to a lateral side of the unitary midsole and connecting the front midsole portion to the rear midsole portion;

a divided footwear upper including a front upper portion and a separate rear upper portion; wherein the front upper portion is fixed to the front midsole portion and defines at least a forefoot region of the divided footwear upper, and the rear upper portion is fixed to the rear midsole portion and defines a heel region of the divided footwear upper; wherein the front midsole portion and the rear midsole portion are selectively pivotable relative to one another at the living hinge between a use position and an access position;

wherein a bottom surface of the unitary midsole defines a groove extending from the medial side of the unitary midsole to the lateral side of the unitary midsole, and a top surface of the unitary midsole defines a slit disposed over the groove and extending from the medial side of the unitary midsole to the lateral side of the unitary midsole;

wherein the unitary midsole forms the living hinge at the groove and the slit, with the groove wider in the use position than in the access position, and with the slit wider in the access position than in the use position;

wherein the slit includes:

a main portion extending downward from the top surface of the unitary midsole toward the groove and having a distal end spaced above the groove;

a front branch extending from the distal end of the main portion into the front midsole portion and terminating above the bottom surface; and a rear branch extending from the distal end of the main portion into the rear midsole portion and terminating above the bottom surface;

wherein the unitary midsole is lifted at the living hinge in the access position relative to the use position so that the rear midsole portion inclines from a rear end of the rear midsole portion to the living hinge, and the front midsole portion inclines from a forward end of the front midsole portion to the living hinge; and wherein the bottom surface of the unitary midsole in the heel region has a main portion and a rearmost portion extending from and disposed at an obtuse angle to the main portion so that the main portion of the bottom surface rests on a horizontal ground surface in the use position, and the rearmost portion of the bottom surface rests on the horizontal ground surface in the access position.

12. The article of footwear of claim 11, wherein a top surface of the rear midsole portion has a main portion and a rearmost portion extending from and disposed at an obtuse angle to the main portion so that the rear midsole portion has a ridge between the rearmost portion of the bottom surface and the rearmost portion of the top surface.

13. The article of footwear of claim 11, further comprising:

an elastic biasing member that extends around a rear periphery of the rear upper portion and along a medial side of the article of footwear and a lateral side of the article of footwear; and wherein the elastic biasing member is secured to the article of footwear forward of the living hinge.

* * * * *